US007906186B2

(12) United States Patent
Watanabe et al.

(10) Patent No.: US 7,906,186 B2
(45) Date of Patent: Mar. 15, 2011

(54) INK JET RECORDING MEDIUM

(75) Inventors: Toshiyuki Watanabe, Shizuoka (JP); Hiroshi Yamamoto, Shizuoka (JP); Taihei Noshita, Shizuoka (JP); Kouichi Sasaki, Shizuoka (JP)

(73) Assignee: FUJIFILM Corporation, Tokyo (JP)

( * ) Notice: Subject to any disclaimer, the term of this patent is extended or adjusted under 35 U.S.C. 154(b) by 927 days.

(21) Appl. No.: 11/721,702

(22) PCT Filed: Jan. 13, 2006

(86) PCT No.: PCT/JP2006/300788

§ 371 (c)(1),
(2), (4) Date: Jun. 14, 2007

(87) PCT Pub. No.: WO2006/082712

PCT Pub. Date: Aug. 10, 2006

(65) Prior Publication Data

US 2008/0020152 A1 Jan. 24, 2008

(30) Foreign Application Priority Data

Feb. 4, 2005 (JP) ..... 2005-029788
Sep. 30, 2005 (JP) ..... 2005-287985

(51) Int. Cl.
*B41M 5/40* (2006.01)

(52) U.S. Cl. ..... 428/32.2; 428/32.18; 428/32.21; 428/32.26; 428/32.27; 428/32.28; 428/32.3; 428/32.34

(58) Field of Classification Search ..... 428/32.18, 428/32.2, 32.21, 32.26, 32.27, 32.28, 32.3, 428/32.34
See application file for complete search history.

(56) References Cited

U.S. PATENT DOCUMENTS

| | | | | |
|---|---|---|---|---|
| 2002/0140796 | A1 | 10/2002 | Sumioka et al. | |
| 2003/0203133 | A1 | 10/2003 | Maekawa | |
| 2004/0185193 | A1 * | 9/2004 | Taka et al. | 428/32.18 |
| 2004/0218917 | A1 | 11/2004 | Mizutani et al. | |
| 2004/0246321 | A1 | 12/2004 | Takashima et al. | |
| 2009/0022910 | A1 | 1/2009 | Teramae | |

FOREIGN PATENT DOCUMENTS

| | | | |
|---|---|---|---|
| EP | 1219459 | A2 | 7/2002 |
| EP | 1346842 | A2 | 9/2003 |
| EP | 1459901 | A2 | 9/2004 |
| EP | 1484189 | A2 | 12/2004 |
| EP | 1 500 746 | A2 * | 1/2005 |
| EP | 1571004 | A1 | 9/2005 |
| JP | 58393 | B2 | 2/1993 |
| JP | 08-164589 | A | 6/1996 |
| JP | 2605585 | B2 | 2/1997 |
| JP | 2650604 | B2 | 5/1997 |
| JP | 10203006 | A | 8/1998 |
| JP | 10217601 | A | 8/1998 |
| JP | 10-268111 | A | 10/1998 |
| JP | 10-282312 | A | 10/1998 |
| JP | 1120306 | A | 1/1999 |
| JP | 11-58943 | A | 3/1999 |
| JP | 2001-281411 | A | 10/2001 |
| JP | 2004-249522 | A | 9/2004 |
| JP | 2004-249524 | A | 9/2004 |
| JP | 2004-284147 | A | 10/2004 |
| JP | 2004284147 | A | 10/2004 |
| JP | 2004-351741 | A | 12/2004 |
| JP | 2004351618 | A | 12/2004 |
| JP | 20057849 | A | 1/2005 |
| JP | 2006-56196 | A | 3/2006 |

OTHER PUBLICATIONS

An Extended European Search Report from the EPO dated Feb. 12, 2009.

* cited by examiner

*Primary Examiner* — Betelhem Shewareged
(74) *Attorney, Agent, or Firm* — Sughrue Mion, PLLC

(57) ABSTRACT

An ink jet recording medium comprising a substrate and at least one ink-receiving layer on the substrate, wherein said ink-receiving layer after recording has the characteristic that the sum of image clarity values is 130 or more (when measured by optical combs of 0.125 mm, 0.25 mm, 0.5 mm, 1.0 mm and 2.0 mm) and the regular reflection strength is 30 or more, makes it possible to record a high quality image which has high glossiness and photographic feel.

19 Claims, No Drawings

INK JET RECORDING MEDIUM

TECHNICAL FIELD

The present invention relates to an ink jet recording medium and, particularly, to an ink jet recording medium that is suitable for recording a high quality image having high glossiness and photographic feel (for example, photo glossy paper for ink jet printers).

BACKGROUND ART

An ink jet recording method has become widely used from the viewpoint that recording can be carried out on various recording materials, the hardware (device) is relatively inexpensive and compact and is superior in quietness. With recent developments of high-resolution ink jet printers, hardware (device) and various ink jet recording media, so-called "photo-like" high quality images have become possible.

As an ink jet recording medium, a recording material having high glossiness and color saturation and good ink absorbance is needed from the viewpoint of improving photographic feel. In order to satisfy these characteristics, ultrafine particles having an average primary particle diameter of 50 nm or less are suitable and, for example, vapor phase method silica or alumina sol is preferably used. As specific examples of such media, recording materials obtained by coating a paper support with a silicon-containing pigment containing, for example, silica, together with an aqueous binder are known (see, for example, Japanese Patent Application Laid-Open (JP-A) Nos. 55-51583, 56-157, 57-107879, 57-107880, 59-230787, 62-160277, 62-184879, 62-183382, and 64-11877).

As an ink jet recording material to which glossiness is provided a recording material obtained by a method in which a solution containing a binder, a pigment and a nonionic surfactant is cast (see, for example, JP-A No. 2-113986), and a recording material obtained by a method in which the outermost surface is treated using an aqueous solution containing a cationic polymer electrolyte and then colloidal silica is cast (see, for example, JP-A No. 2-274587) are proposed.

Also, paper is generally used as the support constituting the aforementioned recording materials wherein the paper itself is made to have a function as an ink absorbing layer.

However, in recent years, photo-like recording materials having texture similar to that of a silver salt photographic printing paper are in demand. Since recording materials using a paper support have problems concerning, for example, glossiness, texture, water resistance, and cockling (wrinkles or waving) after recording, resin laminated paper (polyolefin resin coated paper) obtained by laminating a polyolefin resin such as polyethylene on both sides of paper has become widely used (see, for example, JP-A Nos. 13-270232, 13-96898, 13-63205, 12-351270, and 12-522649).

The polyolefin resin coated paper as mentioned above is generally used as silver salt photographic printing paper and is most suitable in making a recording medium having, particularly, a photographic feel in terms of touch and strength as compared with synthetic films represented by a polyethylene terephthalate film.

On the other hand, a dispersion solution of ultrafine particles having an average primary particle diameter of 50 nm or less has poor dispersion stability, causing a problem in that these fine particles tend to be coagulated. Therefore, in the case of using such a dispersion solution of ultrafine particles to prepare a coating solution for forming an ink-receiving layer constituting an ink jet recording medium, these fine particles tend to coagulate due to unstable dispersion, which tends to cause occurrences of cissing and stripe-like coating defects and reduced in ink absorbance.

When a silica dispersion solution is prepared using silica microparticles as ultrafine particles, usually these silica microparticles are primarily dispersed (premixing or predispersing) in a dispersion medium (water, an organic solvent or a mixture of these materials) to form a silica microparticle slurry and then this silica microparticle slurry is secondarily dispersed using a dispersing machine such as a sand mill, ball mill or sand grinder. However, the particle size of the silica dispersion solution prepared using a dispersing machine such as a ball mill or sand grinder is large, and also the dispersion solution is less transparent. Therefore, an ink jet recording medium using this dispersion solution fails to obtain a sufficiently satisfactory gloss level.

In relation to the above, technologies for improving glossiness and image clarity by improving the smoothness of a support and an ink-receiving layer constituting an ink jet recording medium are disclosed (see, for example, JP-A Nos. 2004-284148, 2004-249708, 2004-195781, and 8-11423). The glossiness has been regarded as a measure of gloss from long ago, and image clarity is utilized currently as an index for determining gloss feel.

DISCLOSURE OF THE INVENTION

Problem to be Solved by the Invention

The polyolefin resin coated paper is preferable in the point that it is a recording material allowing a photo-like image to be recorded as mentioned above. However, for example, only coating of paper with a resin or micronization of particles used in the ink-receiving layer that receives ink jet recording ink cannot always constitute a high gloss medium.

Specifically, when paper used as a base is itself inferior in formation, namely, when a small dispersion is present in the distribution of basis weight, there is a difference in the size of voids between paper fibers with the result that when an ink-receiving layer is disposed on resin coated paper that is coated with a thermoplastic resin to prepare an ink jet recording medium, the resulting medium is largely deteriorated in the surface condition and feeling by the influence of the difference in the size of voids. Also, when the dispersibility is insufficient because of, for example, a larger diameter of microparticles (for example, silica microparticles) constituting the ink-receiving layer and uneven dispersion (coagulation), this is also a cause of reduced glossiness. Therefore, it is currently difficult to obtain the quality of a material having photographic feel, particularly, high glossiness by the technologies that have been developed so far.

Also, gloss feel is given as one of the elements supporting photo-like image quality (image quality). As to the gloss, the glossiness obtained by quantitating the reflective strength of observed light and the image visibility (also referred to as image clarity in the invention obtained by quantitating the deformation of the image) have been used as standards as mentioned above. For the image visibility, only the value measured using a 2.0 mm optical comb prescribed in ISO is used. It has been found that though these characteristics serve to express a part of the gloss feel, the gloss feel shown by the measurement does not always accord to the gloss feel actually given to an observer.

When an image is deteriorated in visibility (image clarity) at parts having relatively high frequencies even if, as mentioned above, the value measured using low frequency 2.0 mm optical comb is so large that the large deformation of the image is good (namely, good image visibility), the visibility of the whole image is impaired. This is the same to the inverse of this case. Specifically, when deformation and strain are present in the image even if the glossiness is high, the quality of the image is impaired and a high gloss feel cannot always be obtained.

Means for Solving Problem

It has been found that it is important to express the gloss feel more quantitatively than in the case of a current method and to consider not only the regular reflection strength and the image visibility (image clarity) measured using an optical comb at a specified frequency but also the sum of the values (image visibility) measured using an optical comb at a wide range of frequencies including a major frequency range, namely the whole of the image visibility to improve gloss feel. The invention has been attained by these findings.

The gloss feel meant in the invention is based on the fact that when the sum of each image clarity (the sum of each value (image visibility) measured using optical combs (0.125 mm, 0.25 mm, 0.5 mm, 1.0 mm and 2.0 mm) based on the functional evaluation of observers and the regular reflection strength measured by a goniophotometer respectively exceed a fixed value, the image is superior in gloss feel.

Specific means to attain the above subject is as follows.

<1> An ink jet recording medium comprising a substrate and at least one ink-receiving layer on the substrate, wherein the ink-receiving layer after recording has the characteristic that the sum of image clarity values is 130 or more (when measured by optical combs of 0.125 mm, 0.25 mm, 0.5 mm, 1.0 mm and 2.0 mm) and the regular reflection strength is 30 or more.

<2> The ink jet recording medium of the above <1>, wherein the sum of the above image clarity values is 150 or more.

<3> The ink jet recording medium of the above <1> or <2>, wherein the above regular reflection strength is 40 or more.

In the relationship among the above <1> to <3>, an improvement in the smoothness of the substrate (particularly, base paper) constituting the support and an improvement in the dispersibility of microparticles in the ink-receiving layer are both important and the details of these improvements are as follows.

<4> The ink jet recording medium of any one of the above <1> to <3>, wherein the substrate is base paper made of paper, the base paper having been subjected to calendar treatment during a paper-making stage or after paper-making.

<5> The ink jet recording medium of any one of the above <1> to <4>, wherein the above substrate is base paper made of paper, the base paper having a density of 0.7 to 1.2 g/m$^2$.

<6> The ink jet recording medium of any one of the above <1> to <5>, wherein the above base paper is coated with a polyolefin resin on at least one part of the side on which the above ink-receiving layer is formed.

<7> The ink jet recording medium of the above <6>, wherein the layer thickness of the above polyolefin resin is 20 to 60 μm.

<8> The ink jet recording medium of the above <6> or <7>, wherein the above polyolefin resin is a polyethylene, a polypropylene, or a copolymer of ethylene and a vinyl alcohol.

<9> The ink jet recording medium of any one of the above <1> to <8>, wherein the center average roughness SRa of the above substrate at least on the side on which the above ink-receiving layer is formed is 0.70 μm or less when measured in the condition of a cutoff of 0.05 to 0.5 mm, and is 0.80 μm or less when measured in the condition of a cutoff of 1 to 3 mm.

<10> The ink jet recording medium of any one of the above <1> to <9>, wherein the above ink-receiving layer contains inorganic microparticles or organic microparticles.

<11> The ink jet recording medium of the above <10>, wherein the solid content of the above inorganic microparticles or organic microparticles in the ink-receiving layer is 50% by mass or more.

<12> The ink jet recording medium of any one of the above <10> and <11>, wherein the above ink-receiving layer contains inorganic microparticles.

<13> The ink jet recording medium of any one of the above <10> to <12>, wherein the inorganic microparticles are silica microparticles, colloidal silica, alumina microparticles or pseudo boehmite.

<14> The ink jet recording medium of any one of the above <1> to <13>, wherein the above ink-receiving layer is formed using a dispersion solution which contains inorganic microparticles and formed by an ultrasonic dispersing machine or a high pressure dispersing machine.

<15> The ink jet recording medium of any one of the above <1> to <14>, wherein the above ink-receiving layer has a layer thickness of 20 to 40 μm.

<16> The ink jet recording medium of any one of the above <1> to <15>, wherein the above ink-receiving layer contains a water-soluble resin.

<17> The ink jet recording medium of any one of the above <1> to <16>, wherein the above water-soluble resin is a resin having a hydroxy group as a hydrophilic structural unit.

<18> The ink jet recording medium of any one of the above <1> to <17>, wherein the above resin having a hydroxy group as a hydrophilic structural unit is a polyvinyl alcohol type resin.

<19> The ink jet recording medium of any one of the above <1> to <18>, wherein the above ink-receiving layer contains a boron compound as a crosslinking agent for a hydrophilic resin.

<20> The ink jet recording medium of any one of the above <1> to <19>, wherein the above ink-receiving layer contains a mordant.

Effect of the Invention

The invention can provide an ink jet recording medium ensuring that it can record a high quality image having good gloss feel and photographic feel.

BEST MODE FOR CARRYING OUT THE INVENTION

The ink jet recording medium of the present invention will be explained in detail.

The ink jet recording medium of the invention comprises a substrate (especially, base paper) and at least one ink-receiving layer on the substrate and is designed to have a structure capable of forming a high quality image having a photo-like gloss feel.

The ink-receiving layer constituting the ink jet recording medium of the invention is structured so as to satisfy the following requirements for gloss feel after an image is recorded: the sum of image clarity values (each value (image visibility) when optical combs (0.125 mm, 0.25 mm, 0.5 mm, 1.0 mm and 2.0 mm) are used) is 130 or more and the regular reflection strength is 30 or more.

The image clarity values and regular reflection strength are standards expressing gloss and when these standards respectively show a high value, this contributes to high gloss. Particularly in the invention, the above image clarity value is not defined as the value measured using only an optical comb in a specific frequency range (for example, a 2.0 mm optical comb) but defined as the sum of the values (image visibility) measured using optical combs having frequencies ranging from low frequencies to high frequencies including a main frequency range, that is, one representing the whole of the image visibility and also the ink-receiving layer is made to have a structure that satisfies both the specified image clarity value and the regular reflection strength, whereby an image having a gloss feel and photographic feel that observers feel good can be obtained.

In the invention, the sum of the above image clarity values, specifically, the total of each value (image visibility) measured using optical combs (0.125 mm, 0.25 mm, 0.5 mm, 1.0 mm and 2.0 mm) is made to be 130 or more. If the sum is less than 130 when the image clarity value is regarded as the sum of plural values in a wide frequency range as mentioned above, it is not always possible to obtain a gloss feel improved to the extent that observer feels good even if the regular reflection strength which will be explained later is 30 or more.

The above sum of image clarity values is preferably 150 or more and more preferably 170 or more though it is preferably higher. The upper limit is, for example, about 420, though there is no restriction to it.

The sum of image clarity values according to the invention is a total (=Value $C^1$ at 2.0 mm+Value $C^2$ at 1.0 mm+Value $C^3$ at 0.5 mm+Value $C^4$ at 0.25 mm+Value $C^5$ at 0.125 mm) of each value (%; image clarity value C) measured using 2.0 mm, 1.0 mm, 0.5 mm, 0.25 mm and 0.125 mm combs by an image clarity value measuring meter (trade name: ICM-1, manufactured by Suga Test Instrument Co., Ltd.) according to the Image Clarity Value Test Method prescribed in JIS H8686-2.

The conditions of measurement and analysis at this time are as described below. The measurement is made both in the main scanning direction and in sub-scanning direction of the printing on the image part recorded by ink jet recording ink to find the image clarity value C for every comb from the following equation (a) and then, the image clarity values C calculated for each comb are summed up to find the sum of the image clarity values.

<Condition of Measurement and Analysis>

$$\text{Image clarity value } C\,(\%)=\{(M-m)/(M+m)\}\times 100 \qquad \text{Equation (a)}$$

where M represents a maximum wave height and m represents a minimum wave height.

Method of measurement: Reflection

Angle of measurement: 60°

In the invention, the sum of image clarity values is made to fall in the above range and at the same time, the regular reflection strength is designed to be 30 or more. If the regular reflection strength is less than 30, it is not always possible to obtain a gloss feel improved to the extent that observer feels good even if the aforementioned sum of the image clarity value falls in the range over 130.

Although the above regular reflection strength is preferably higher, it is preferably 40 or more. Though there is no upper limit, the upper limit is, for example, about 95.

The regular reflection strength according to the invention is the peak value of reflection strength found by measuring the deformation by using a glossiness measuring meter (trade name: THREE-DIMENTIONAL AUTO-GONIOPHOTOMETER GP-200, manufactured by Murakami Color Research Laboratory) at an incident angle of 45° and a light acceptance angle of 30° to 60° under the following measurement condition.

<Condition of Measurement>

Resolving power: 0.1°

Diaphragm of incident light (aperture): 10 mm×10 mm

Diaphragm size on the light receiving side: 4.5 mmϕ

Calibrating method: Black standard plate (refractive index: 1.518)

In the above explanations, the sum of image clarity values and regular reflection strength according to the invention are not both the characteristics before recording and it is necessary that the both respectively fall in the above range after an image is recorded. As the test sample used for measuring the sum of image clarity values and regular reflection strength, a black solid image recorded by an ink jet in a specific recording condition is used.

The above specific recording condition means that a printer (trade name: G-800, manufactured by Seiko Epson Corporation) is used and the recording is carried out in the following condition.

Paper setting: EPSON photographic paper

Image quality setting: Recommended setting <fine>

Paper size: L-size, with a margin

Image data: 8 bit RGB data, non-compressed image

Data in an image: Uniform image data, R=0, G=0, B=0 (value: decimal digit value)

Image size, resolution: 5 cm×5 cm, 720 dpi

Moisture control prior to printing: 23° C., 50% RH, 6 hours or more

Drying condition before the measurement of image clarity value and regular reflection strength after printing: dried in the condition of 23° C., 50% RH for 24 hours.

When the ink jet recording medium of the invention is constituted of base paper, pulp perfect stuff obtained by beating desired pulp, particularly, pulp slurry prepared by beating is subjected to paper-making to thereby obtain the base paper. A paper-making step for making paper involves a step of drying by pressing a dryer canvas of the web surface side corresponding to the surface of the base paper to which the recording layer is to be applied by application, against a drum dryer cylinder. In this step, the base paper may be dried by adjusting the tensile strength of the dryer canvas to a range from 1.5 to 3 kg/cm.

No particular limitation is imposed on the above pulp and the pulp may be suitably selected from natural pulps selected from LBKPs (broad-leaved tree bleached kraft pulps) such as broad-leaved trees, for example, aspen wood, acacia wood, maple wood, poplar wood and eucalyptus wood, NBKPs (coniferous tree bleached kraft pulps) such as spruce wood and Douglas fir wood, LBSPs, NBSPs, LDPs, NDPs, LUKPs and NUKPs. These materials may be used in combinations of two or more besides the case of using these materials alone.

The pulp constituting the base paper preferably has a composition of craft pulp (maple wood LBKP) constituted of maple wood in an amount of 30% by mass or more and preferably 50% by mass or more. When the proportion of the maple wood LBKP in the pulp is 30% by mass or more, the smoothness of the support is improved and gloss feel is further improved.

No particular limitation is imposed on a method of producing, for example, the aforementioned craft pulp (LBKP), usual methods of producing craft pulp may be widely used. The craft pulp is beaten such that the water retentivity thereof falls in a specified range and then a sizing agent and the like are added to the pulp according to the need to prepare pulp slurry. Then, prepared pulp slurry is subjected to paper-making. When the craft pulp is made to be a mixture of plural types, one craft pulp is beaten and adjusted, and also other pulps are beaten and adjusted and then mixed in the above pulp.

When making paper, the freeness of the LBKP after it is beaten is preferably 200 to 400 ml based on the provisions of Canada Standard Freeness (C.S.F). When the freeness is in the above range, the swelling/shrinkage factor is small and good surface condition (surface smoothness) is obtained. The freeness is a value measured according to the Canada Standard Model Test Method in JIS-P-8121 "Test method of the freeness of pulp".

Also, the water retentivity of the pulp after it is beaten is preferably 100 to 200%. When the water retentivity of the beaten pulp constituting a pulp perfect stock prior to paper-making falls in the above range, the expansion/shrinkage factor of the pulp is small to thereby obtain the surface characteristics having high gloss and decreased in irregularities.

The water retentivity is measured based on the provisions described in a JAPAN TAPPI paper pulp test method No. 26:2000 (Pulp-water retentivity test method). In this method, water contained in a pulp suspension solution is removed by centrifugation to measure the water retentivity of the pulp after water is removed. Specifically, a beaten-pulp suspension solution is suction-filtered using proper filter containers called a centrifuging cup and then the pulp residue is poured into a precipitation tube every container to centrifuge the pulp in a fixed condition for a fixed time. Then, the wet pulp dehydrated by centrifugation is taken out to weigh. Then, the wet pulp after dehydrated by centrifugation is dried completely at 105° C. to solid. Then, the mass of the wet pulp after dehydrated by centrifugation is "A" and the mass of the pulp after dried to solid is "B" to calculate the water retentivity by the following equation:

$$\text{Water retentivity (\%)}=(A-B)/B\times 100$$

As the pulp, pulp reduced in impurities is preferably used and it is useful to use pulp (bleached pulp) improved in whiteness by bleaching treatment.

Among the above materials, broad-leaved bleached craft pulp (bleached LBKP) improved in whiteness by bleaching treatment is preferable in the point of foreign matters and hue. Among these materials, broad-leaved bleached craft pulp (bleached LBKP) constituted of at least one type selected from aspen wood, acacia wood, maple wood and poplar wood is particularly preferable. These bleached LBKPs may be preferably used either alone or in combinations of two or more, or as mixed pulps of one or two or more of bleached LBKPs and one or two or more of the aforementioned other pulps.

The content of the pulp in the base paper of the invention, specifically, in the pulp perfect stock used to make the base paper is preferably 60% by mass or more and more preferably 80% by mass or more.

The pulp paper perfect stock prior to paper-making may further contains anionic colloidal silica. Specifically, it is preferable to make the base paper according to the invention by paper-making after the anionic colloidal silica is added. The inclusion of the anionic colloidal silica makes it possible not only to heighten dehydration ability (namely, functions as a freeness adjuvant) but also is effective to improve, particularly, sharpness, namely, a cutting aptitude.

The specific surface area of the above anionic colloidal silica is preferably in a range from 100 to 1,000 $m^2/g$ and the average particle diameter is preferably in a range from 1 to 20 nm.

When the above anionic colloidal silica is contained, the content of the above anionic colloidal silica is preferably 0.005 to 0.5% by mass and more preferably 0.01 to 0.2% by mass from the point of improving the aforementioned cutting aptitude and dehydration ability.

No particular limitation imposed on the paper-making machine for paper-making using the pulp paper perfect stock and a proper one suitably selected from conventional known paper-making machines may be used. Examples of the paper-making machine may include a Fourdrinier paper machine provided with a shaking machine having a stroke of 10 mm or more. A paper-making machine having a dandy roll (for example, a paper-making machine provided with a dandy roll made of a 60 to 100 mesh wires) is preferable.

The base paper according to the invention is natural pulp paper containing usual natural pulp as its major component and various chemicals may be added to this base paper. Examples of these various additives include fillers such as clay, talc, calcium carbonate and urea resin microparticles, sizing agents such as rosin, alkyl ketene dimers, higher fatty acid salts, paraffin wax and alkenyl succinic acids, paper force enforcers such as starch, polyacrylamide and polyvinyl alcohol, water retentive agents such as polyethylene glycol and fixing agents such as alum cake. Besides the above additives, dyes, white pigments such as titanium oxide, fluorescent dyes, slime control agents, antifoaming agents and softeners such as quaternary ammonium may be added.

The surface of the base paper made of natural pulp paper may be subjected to surface sizing treatment using a coating film forming polymer such as gelatin, starch, carboxymethyl cellulose, polyacrylamide, polyvinyl alcohol and denatured polyvinyl alcohol. Examples of the denatured polyvinyl alcohol include carboxyl group modified products, silanol modified products and copolymers of polyvinyl alcohols and acrylamides. Also, the amount of the coating film forming polymer to be applied when the surface sizing treatment is performed using the above coating film forming polymer is preferably adjusted to 0.1 to 5.0 $g/m^2$ and more preferably 0.5 to 2.0 $g/m^2$. Antistatic agents, fluorescent bleaching agents, pigments and antifoaming agents may be added to the above coating film forming polymer according to the need.

Although base paper generally has water in a content of about 7.0% by mass, the content of water in the base paper according to the invention is preferably 7.5 to 10% by mass and more preferably 8.0 to 10% by mass in consideration of the formation of the base paper.

Also, the thickness of the base paper is preferably 150 to 250 μm though there is no particular limitation to the thickness. Also, the basis weight of the base paper is preferably 150 to 250 $g/m^2$ and particularly preferably 180 to 220 $g/m^2$.

The base paper according to the invention is preferably one having excellent surface smoothness and planeness in consideration of the case, such as photographic printing paper, where planeness is desired. From this point of view, the base paper may be subjected to calendaring treatment using a machine calendaring or super calendaring during paper-making or after paper-making to thereby apply heat and pressure to the base paper, thereby making it possible to impart a higher level of smoothness to the base paper.

The density of the base paper is usually 0.7 to 1.2 $g/m^2$ (JIS P-8118). Also, the stiffness of the base paper is preferably 1.0 to 3.0 mNm as MD (vertical direction) and 0.5 to 1.5 mNm as CD (lateral direction) in the condition prescribed in JIS P-8125 (2000).

A surface sizing agent may be applied to the surface of the base paper. As the surface sizing agent, the same sizing agent as those that may be added to the above raw paper may be used.

Also, the pH of the base paper is preferably 5 to 9 as a value measured by a hot water extraction method prescribed in JIS P-8113.

The aforementioned sum of image clarity values and regular reflection strength may be respectively adjusted to the aforementioned range by controlling the center average roughness (SRa) of the surface of the substrate (particularly, the base paper) to improve the smoothness of the substrate (particularly, the base paper).

Specifically, the center average roughness (SRa) of at least the surface (one or both sides of the substrate) of the substrate (particularly, the base paper) on which surface the ink-receiving layer is to be formed is made to be 0.70 μm or less when measured in the condition of a cutoff of 0.05 to 0.5 mm, and is 0.80 μm or less when measured in the condition of a cutoff of 1 to 3 mm, thereby making it possible to adjust properly.

The aforementioned center average roughness (SRa) is an index used to rate the smoothness (surface smoothness) of the surface of the substrate (particularly, the base paper). When the center average roughness SRa is out of the above range, there is the case where a gloss feel and surface smoothness preferable to form a photo-like image cannot be obtained when such a substrate is used to constitute an image recording material.

In other words, if SRa measured in the condition of a cutoff of 0.05 to 0.5 mm exceeds 0.70 μm, a reflected image looks blurred because of direct reflection of a fluorescent light, which largely impairs image clarity largely controlling a gloss feel when this substrate is used to constitute an ink jet recording medium. Also, if SRa measured in the condition of a cutoff of 1 to 3 mm exceeds 0.80 μm, a reflected image looks deformed because of direct reflection of a fluorescent light, which largely impairs image clarity largely controlling a gloss feel when this substrate is used to produce an ink jet recording medium.

The above SRa is preferably 0.60 μm or less in the condition of a cutoff of 0.05 to 0.5 mm and 0.6 μcm or less in the condition of a cutoff of 1 to 3 mm. The lower limit of each SRa is preferably closer to 0 μm.

The above center average roughness SRa is a value preferably measured using ZYGO NEW VIEW 5000 (manufactured by ZYGO (k.k.)) in the condition of a cutoff of 0.05 to 0.5 mm and NANOMETRO 110F (manufactured by Kuroda Seiko (k.k.) in the condition of a cutoff of 1 to 3 mm.

In the above explanations, the sum of image clarity values and regular reflection strength are controlled from the viewpoint of improving the smoothness of the substrate (particularly, base paper). It is possible to adjust the aforementioned image clarity values and regular reflection strength to the aforementioned range by adjusting a dispersion state (dispersibility) of the inorganic microparticles in the ink-receiving layer forming coating solution by using a ultrasonic dispersing machine or a high pressure dispersing machine (particularly, a high pressure jet dispersing machine), separately from or in combination with the above method, to control the dispersion condition of the inorganic microparticles. The details of the inorganic microparticle are as described below.

Specifically, the above characteristics may be appropriately adjusted by treating using not a dispersing machine (for example, a beads mill dispersing machine), which is generally used to disperse inorganic microparticles but an ultrasonic dispersing machine or high pressure dispersing machine. As the high pressure dispersing machine, for example, a liquid-liquid counter collision system dispersing machine (for example, trade name: ALTIMIZER SYSTEM, manufactured by Sugino Machine Limited) is preferable. A dispersion solution obtained by treating using this dispersing machine has high transparency and an ink jet recording medium (particularly an ink-receiving layer) using this dispersion solution has a high degree of glossiness.

In the dispersion using the above ultrasonic dispersing machine, an ultrasonic wave is applied to a pre-dispersed solution which contains the inorganic microparticles and is put in a pre-dispersed state to more disperse, to thereby obtain a dispersion solution. Any ultrasonic machine may be used without any particular limitation insofar as it can apply an ultrasonic wave and for example, an ultrasonic dispersing machine (trade name: UH-600H, manufactured by (k.k.) SMT may be preferably used.

In the dispersion using the above high pressure dispersing machine, a pre-dispersed solution which contains the inorganic microparticles and is put in a pre-dispersed state is subjected to liquid-liquid counter collision carried out under pressure or is made to pass through an orifice under high pressure to further disperse the inorganic microparticles to obtain a dispersion solution. There is no particular limitation to the high pressure dispersing machine insofar as it has a structure allowing counter collision under pressure and the solution to pass through an orifice, and generally, a commercially available machine called a high pressure homogenizer may be preferably used.

It is to be noted that the orifice is a mechanism obtained by inserting a thin plate (orifice plate) formed with fine holes having, for example, a circular shape into a straight pipe and by sharply narrowing a part of the passage of the straight pipe.

The high pressure dispersing machine is basically a system comprising a high pressure generating part, and a liquid-liquid counter collision part or an orifice part. As the above pressure generating part, a high pressure pump, which is generally called a plunger pump, is preferably used. Although the above high pressure pump includes a single type, twin type and triple type, any of these types may be applied without any particular limitation.

Examples of the high pressure dispersing machine include a NANOMIZER manufactured by Nanomizer (k.k.), MICROFLUIDIZER manufactured by Microfluidix (k.k.) and ALTIMIZER manufactured by Sugino Machine Limited.

The process pressure in the case of carrying out liquid-liquid counter collision under high pressure is preferably 50 MPa or more, more preferably 100 MPa or more and particularly preferably 130 MPa or more. Also, a difference in pressure between the inlet side and outlet side of the orifice when the solution is passed through the orifice is preferably 50 MPa or more, more preferably 100 MPa or more and particularly preferably 130 MPa similarly to the above process pressure.

In any case, dispersion efficiency is dependent on the process pressure and is therefore increased with an increase in process pressure. The upper limit of the process pressure is 350 MPa. When the process pressure is less than 350 MPa, this is preferable in the point of the pressure resistance of piping of a high-pressure pump and the durability of equipment.

The number of treating times is usually selected from 1 to several tens times though no particular limitation to it.

Various additives may be added when the dispersion solution is prepared.

Examples of the additives include nonionic or cationic surfactants (anionic surfactants are not preferable because they form an aggregate), antifoaming agents, nonionic hydrophilic polymers (for example, polyvinyl alcohol, polyvinyl pyrrolidone, polyethylene oxide, polyacrylamide, various types of sugar, gelatin and pluran), nonionic or cationic latex dispersion solution, water-miscible organic solvents (for example, ethyl acetate, methanol, ethanol, isopropanol, n-propanol and acetone), inorganic salts and pH regulators and these additives may be added according to the need.

The above water miscible organic solvents are preferable particularly in the point of limiting the formation of fine pills when the inorganic microparticles (particularly, vapor phase method silica) are pre-dispersed. When this water miscible organic solvent is added, the amount of the water miscible organic solvent is preferably 0.1 to 20% by mass and particularly preferably 0.5 to 10% by mass in the dispersion solution.

Also, the pH of the dispersion solution when the dispersion solution of the inorganic microparticles (particularly vapor phase method silica) is generally in a range from 1 to 8 and particularly preferably in a range from 2 to 7, though it varies widely depending on the type of inorganic microparticles (particularly vapor phase method silica) and other components such as various additives.

When the dispersion solution of the inorganic microparticles is prepared, the average primary particle diameter of the inorganic microparticles is preferably 30 nm or less, more preferably 20 nm or less, still more preferably 10 nm or less and particularly preferably 3 to 10 nm. Moreover, it is preferable that the average primary particle diameter of the inorganic microparticles be 30 nm or less and the secondary particle diameter of the inorganic microparticles in the dispersion solution after the inorganic microparticles are dispersed be 200 nm or less (preferably 150 nm or less and particularly preferably 120 nm or less).

An embodiment is also preferable in which besides the above additives, a water-soluble organic cationic compound and/or a water-soluble polyvalent compound are added to disperse the microparticles under the presence of these compounds by using the aforementioned dispersing machine according to the invention.

<Water-Soluble Organic Cationic Compound>

The inorganic microparticles are preferably used in the condition that these inorganic microparticles are pre-dispersed prior to the aforementioned dispersion. In this case, it is possible to well disperse these organic microparticles by compounding at least one type of water-soluble organic cationic compounds as a dispersant (coagulation preventive).

Although no particular limitation is imposed on the water-soluble organic cationic compound, water-soluble organic cationic compounds (including salts of these compounds), for example, mordants which will be explained later, having first to tertiary amino groups, quaternary ammonium salt group or phosphonium salt group are preferable. Among these compounds, those having an average molecular weight of 50,000 or less are preferable and those having a molecular weight of 20,000 or less are particularly preferable. A silane coupling agent may be used as other dispersants.

Among the above water-soluble organic cationic compounds, particularly water-soluble organic cationic compounds having a polydiallylamine derivative as a structural unit are preferable. These water-soluble organic cationic compounds can be obtained by cyclization condensation of a diallylamine compound. Examples of commercially available products of the water-soluble organic cationic compound include SHAROLL DC902P (manufactured by Dai-ichi Kogyo Seiyaku Co., Ltd.), JET FIX 110 (manufactured by Satoda Kako (sha)), UNISENSE CP-101 to 103 (manufactured by Senka (sha)) and PAS-H (manufactured by Nittobo).

The amount of the above water-soluble organic cationic compound is preferably 1 to 10% by mass and more preferably 1 to 5% by mass based on the inorganic microparticles. When the amount of the water-soluble organic cationic compound is large, the gelation ability of the coating solution after the solution is applied is reduced though depending on the type of vapor phase method silica as mentioned above.

As the above water-soluble organic cationic compound, a water-soluble or aqueous emulsion type is preferably used. Examples of the water-soluble organic cationic compound include polycationic type cationic resins such as dicyan type cationic resins represented by a dicyandiamide-formalin polymerization condensate, polyamine type cationic resins represented by dicyanamide-diethylenetriamine polymerization condensate, epichlorohydrin-dimethylamine addition polymers, dimethyldiallylammonium chloride-$SO_2$ copolymers, diallylamine salt-$SO_2$ copolymers, dimethyldiallylammonium chloride polymers, polymers of allylamine salts, dialkylaminoethyl(meth)acrylate quaternary salt polymers and acrylamide-diallylamine salt copolymers. Among these resins, dimethyldiallylammonium chloride, monomethyldiallylammonium chloride and polyamidine are preferable, and dimethyldiallylammonium chloride and monomethylammonium chloride are particularly preferable in the point of water resistance. These water-soluble organic cationic compounds may be either alone or in combinations of two or more.

The content of the water-soluble organic cationic compound in the ink-receiving layer is preferably 1 to 10% by mass and more preferably 1 to 5% by mass based on the mass of the inorganic microparticles.

The water-soluble organic cationic compound may be added in the dispersion medium before the inorganic microparticles are added, during premixing or after the microparticles are dispersed. It is preferable to add the water-soluble organic compound particularly before the inorganic microparticles are added in the dispersion medium from the viewpoint of obtaining a more stable dispersion solution.

(Water-Soluble Polyvalent Metal Compound)

The dispersion may be carried out by compounding at least one of water soluble polyvalent metal compounds in combination with none or at least one of the above water-soluble organic cationic compounds.

The water-soluble polyvalent metal compound may be added in the dispersion medium before the inorganic microparticles are added, during premixing or after the microparticles are dispersed. It is preferable to add the water-soluble polyvalent metal compound particularly before the inorganic microparticles are added in the dispersion medium from the viewpoint of obtaining a more stable dispersion solution.

As the water-soluble polyvalent metal compound, tri- or higher-valent metal compounds are preferable. Examples of these metal compounds include, further, water-soluble salts of metals selected from calcium, barium, manganese, copper, cobalt, nickel, aluminum, iron, zinc, zirconium, chromium, magnesium, tungsten and molybdenum.

Specific examples of these metal salts include calcium acetate, calcium chloride, calcium formate, calcium sulfate, calcium butylate, barium acetate, barium sulfate, barium phosphate, barium oxalate, barium naphthoresorcin carboxylate, barium butylate, manganese chloride, manganese acetate, manganese formate dihydrate, ammonium manganese sulfate hexahydrate, cupric chloride, ammonium copper (II) chloride dihydrate, copper sulfate, copper (II) butylate, copper oxalate, copper phthalate, copper citrate, copper gluconate, copper naphthanate, cobalt chloride, cobalt thiocyanate, cobalt sulfate, cobalt (II) acetate, cobalt naphthanate, nickel sulfate hexahydrate, nickel chloride hexahydrate, nickel acetate tetrahydrate, ammonium nickel sulfate hexahydrate, nickel amidesulfate tetrahydrate, nickel sulfamate, nickel 2-ethylhexanate, aluminum sulfate, aluminum sulfite, aluminum thiosulfate, aluminum polychloride, aluminum nitrate nonahydrate, aluminum chloride hexahydrate, aluminum acetate, aluminum lactate, basic aluminum thioglycolate, ferrous bromide, ferrous chloride, ferric chloride, ferrous sulfate, ferric sulfate, Iron (III) citrate, iron (III) lactate trihydrate, triammoniumiron (III) trioxalate trihydrate, zinc bromide, zinc chloride, zinc nitrate hexahydrate, zinc sulfate, zinc acetate, zinc lactate, zirconium acetate, zirconium chloride, zirconium chloride oxide octahydrate, zirconium hydroxychloride, chromium acetate, chromium sulfate, magnesium acetate, magnesium oxalate, magnesium sulfate, magnesium chloride hexahydrate, magnesium citrate nonahydrate, sodium phosphorous tungstate, sodium tungsten citrate, 12-tungstophosphoric acid n-hydrate, 12-tungstsilicic acid 26-hydrate, molybdenum chloride and 12-molybdophosphoric acid n-hydrate. These water-soluble polyvalent metal compounds may be used in combinations of two or more.

In the invention, the term "water-soluble" in the water-soluble polyvalent metal compound means that the metal compound dissolves in an amount of 1% by mass or more in 20° C. water.

Among the above water-soluble polyvalent metal compounds, compounds of aluminum or the 4A group metal (for example, zirconium and titanium) in the periodic chart are preferable. Water-soluble aluminum compounds are particularly preferable. Examples of the water-soluble aluminum compound include inorganic salts such as aluminum chloride or its hydrate, aluminum sulfate or its hydrate and ammonium alum. Also, preferable examples of inorganic type aluminum-containing cationic polymer include basic aluminum polyhydroxide.

Examples of the basic aluminum polyhydroxide include water-soluble aluminum polyhydroxides which contain, as a major component, a group represented by the following formula 1, 2 or 3, such as $[Al_6(OH)_{15}]^{3+}$, $[Al_8(OH)_{20}]^{4+}$ and $[Al_{13}(OH)_{34}]^{5+}$ and $[Al_{21}(OH)_{60}]^{3+}$, and also contain a basic and high-molecular polynuclear condensed ion stably.

$$[Al_2(OH)_nCl_{6-n}]_m \quad \text{Formula 1}$$

$$[Al(OH)_3]AlCl_3 \quad \text{Formula 2}$$

$$Al_n(OH)_mCl_{(3n-m)}\ [0 \leqq m \leqq 3n] \quad \text{Formula 3}$$

Wherein, n and m respectively denote an integer.

These compounds are commercially available under the name of ALUMINUM POLYCHLORIDE (PAC) as a water treating agent from Taki Chemical Co., Ltd., under the name of ALUMINUM POLYHYDROXIDE (Paho) from Asada Kagaku (k.k.), under the name of HAP-25 from (k.k.) Riken Green, and under the name of ARFINE 83 from Daimei Kagaku (k.k.) and also from other makers having the same intentions and therefore various grades of materials are easily obtained.

Preferable examples of the above water-soluble polyvalent metal compound containing the 4A group metal in the periodic chart include water-soluble compounds containing titanium or zirconium. Examples of the water-soluble compound containing titanium include titanium chloride and titanium sulfate. Examples of the water-soluble compound containing zirconium include zirconium acetate, zirconium chloride, zirconium oxychloride, zirconium hydroxychloride, zirconium nitrate, basic zirconium carbonate, zirconium hydroxide, zirconium lactate, zirconium/ammonium carbonate, zirconium/potassium carbonate, zirconium sulfate and zirconium fluoride.

The content of the above water-soluble polyvalent metal compound in the ink-receiving layer is preferably in a range from 0.1 to 10% by mass and more preferably in a range from 0.5 to 8% by mass based on the inorganic microparticles.

The dispersion medium used to disperse the inorganic microparticles is preferably water or a mixed solvent of water and a small amount of an organic solvent (low-boiling point solvents such as a lower alcohol or ethyl acetate). In this case, the amount of the organic solvent is preferably 20% by mass or less and more preferably 10% by mass or less based on all dispersion medium.

The premixing (premixing, pre-dispersion) before the above dispersion using a high pressure dispersing machine or ultrasonic dispersing machine may be carried out using a usual propeller stirring, turbine type stirring, homomixer type stirring or the like. For example, a high pressure dispersing machine (particularly, a high pressure jet dispersing machine) or ultrasonic dispersing machine is used for secondary dispersion as mentioned above.

Also, it is preferable to use a method in which the inorganic microparticles are added step by step from the viewpoint of more increasing the concentration of the inorganic microparticles in the dispersion solution.

In the invention, no particular limitation is imposed on liquid temperature when performing the premixing or pre-dispersion as primary dispersion and the temperature is preferably 30° C. or less and particularly preferably 25° C. or less in the point of the possibility of stable preparation of a slurry of the inorganic microparticles (particularly, silica microparticles). In this case, the temperature of the dispersion medium before the inorganic microparticle are added may be made to be 20° C. or less or may be cooled during premixing to drop its temperature to 20° C. or less.

Also, it is preferable to inject the slurry of the inorganic microparticles into a dispersing machine in the condition that the temperature of the slurry is 20° C. or less and particularly 15° C. or less from the viewpoint of obtaining a more stable dispersion solution.

Necessary time taken since the dispersion solution and/or the coating solution for forming the ink-receiving layer (ink-receiving layer coating solution) is prepared until it is applied to the substrate is preferably 5 hours or more and more preferably 8 hours or more from the viewpoint of stabilizing the coating surface condition. There is no upper limit and several days to tens of days may be allowed. The temperature of the dispersion solution during the passage is about 10° C. to about 40° C. and preferably about 15° C. to about 35° C. During the passage, the dispersion solution may be stirred slowly to prevent the inorganic microparticles from settling.

It is also preferable to carry out heat treatment at 45° C. or less after the inorganic microparticles are dispersed and before the ink-receiving layer coating solution is applied, to apply the coating solution after this heat treatment is finished in view of the stability of the coating solution. Particularly, it is preferable that the dispersion solution of the inorganic microparticles be heat-treated at a temperature range from 30 to 48° C. and preferably 40 to 45° C. for about 120 minutes or more (though there is no upper limit, the treating time is preferably about 1 hour or more and about 24 hours or less) and then the ink-receiving layer coating solution be prepared to apply it.

Moreover, an embodiment comprising a combination of the treatment in which the dispersion solution of the inorganic microparticles is allowed to stand for 5 hours or more and heat treatment is particularly preferable.

The dispersion solution of the inorganic microparticles prepared in the above manner or a mixture of the dispersion solution, a hydrophilic binder such as polyvinyl alcohol, a crosslinking agent of the hydrophilic binder, a surfactant, water-dispersible cationic resin or the like is used to prepare each in receptor layer coating solution. Then, one of these coating solutions is applied as a coating solution to the substrate (support) such as paper, polyolefin resin coated paper or a plastic resin film to produce the ink jet recording medium of the invention.

When the dispersion solution is prepared in the above manner, the concentration of the inorganic microparticles in the dispersion solution is appropriately about 10 to 40% by mass and preferably 15 to 35% by mass.

Also, the concentration of the inorganic microparticles (particularly silica microparticles) in the ink-receiving layer coating solution is appropriately about 5 to 25% by mass and preferably 8 to 20% by mass. The amount of the inorganic microparticles in the ink-receiving layer is preferably in a range from 5 to 30 $g/m^2$.

The ink jet recording medium of the invention is preferably used by co-dissolving a water-soluble resin, a surfactant and a water-soluble organic solvent having a boiling point of 150° C. or more in an aqueous solution (aqueous medium).

When the base paper is made of the substrate (support), the formation index of the paper is also important to improve the surface condition properties and surface feel when looking at the surface. The base paper according to the invention is preferably constituted of paper having a formation index of 60 or more.

The formation is better with an increase in the above formation index. When the formation index is particularly made to fall in the above range, it is possible that the paper is free from formation unevenness, has uniform smoothness and is improved in the surface condition properties and surface feel when looking at the surface.

In other words, when the formation index is less than 60, there is the case where generation of formation unevenness is significant, bringing about deterioration in surface condition uniformity and surface feel. As a result, the ability of forming a photo-like high quality image is impaired when an image recording material is structured.

The above formation index is preferably 70 or more in the above range.

The formation index is measured by using a 3D sheet analyzer (trade name: M/K950, manufactured by M/K Systems, Inc. (MKS Company)) wherein the diaphragm of the analyzer is set to a diameter of 1.5 mm and also measured using a microformation tester (MFT).

Specifically, a sample is attached to the rotating drum of the 3D sheet analyzer to measure a local difference in basis weight in the sample as a difference in the quantity of light by a light source set to the shaft of the drum and a photodetector disposed on the outside of the drum corresponding to the light source. At this time, the range subjected to measurement is determined by the diameter of the diaphragm set to the light incident part of the photodetector. Then, the difference in light quantity (deviation) is amplified, subjected to A/D conversion and divided into 64 photo-detected basis weight classes. 100,000 data is taken by one scanning to obtain the histgram frequencies corresponding to the data. Then, the maximum frequency (peak value) of this histgram is divided by the number of classes having a frequency of 100 or more among those divided into the classes corresponding to 64 photo-detected basis weight classes and the obtained value is divided by 100 to calculate the formation index.

Examples of a method of improving the above formation index, namely the formation of the base paper include a method in which a screen or a turbulent flow cleaner is disposed just before the head box of a paper-making machine to prevent the base paper raw material from flowing in a fixed direction and a method in which addition chemicals such as a dispersant, a formation control additive, a retention and freeness adjuvant are used to control the flocculation of the stock. However, these methods are not intended to be limiting of the invention.

The base paper constituting the ink jet recording medium of the invention is preferably structured by providing a polyolefin resin such that the surface on the side (specifically, one side or both side of the base paper) on which at least one ink-receiving layer is to be formed is coated therewith.

The layer thickness of the polyolefin resin on the side on which the ink-receiving layer is to be formed is preferably in a range from 20 to 60 μm and more preferably 35 to 60 μm. When the layer thickness is within the above range, an image, which is superior in image clarity and has a good gloss feel and a photo-like feel, can be obtained, and this method is effective from the viewpoint of improving productivity and reducing cost.

Particularly, an embodiment in which the layer thickness is in a range from 40 to 55 μm is preferable.

When the polyolefin resin layer is formed on one surface or both surfaces of the base paper, there are methods including melt extrusion, wet lamination and dry lamination to manufacture a support, such as a photographic printing paper support, coated with a resin by laminating the resin. Among these methods, melt extrusion is most preferable. When the polyolefin resin layer is formed by the above melt extrusion, it is preferable to carry out pretreatment to make firm the adhesion of the polyolefin resin layer to the base paper before the polyolefin resin layer is applied to the base paper by melt extrusion. For example, an extrusion laminating method (extrusion coating method) is widely used in which the polyolefin resin extruded from an extrusion die is spread on the traveling base paper to form a resin film such that the base paper is coated with the resin at the nip point between the nip roller and the cooling roller and also nipped to bond the resin with the base paper under pressure thereby laminating the resin film on the base paper.

Examples of the pretreatment include acid etching treatment using a sulfuric acid/chromic acid mixed solution, flame treatment using gas flame, ultraviolet ray radiation treatment, corona discharge treatment, glow discharge treatment and anchor coating treatment using, for example, an alkyl titanate and a proper treatment is freely selected from these treatments. Particularly, corona treatment is preferable in view of simplicity. In the case of corona treatment, it is necessary to treat in such a manner as to allow the surface to have a contact angle of 70° or less with water.

As the above anchor coating agent, for example, an organic titanium type, isocyanate type (urethane type), polyethyleneimine type and polybutadiene type are known. Specifically, as the organic titanium type, alkyl titanates such as tetraisopropyl titanate, tetrabutyl titanate and tetrastearyl titanate, titanium acylate such as butoxytitanium stearate, titanium chelates such as titanium acetylacetonate are known. Also, as the isocyanate type (urethane type), toluene diisocyanate (TDI), diphenylmethane diisocyanate (MDI), hexamethylene diisocyanate (HMDI), xylylene diisocyanate (XDI) and isophorone diisocyanate (IPDI) are known.

In the invention, in the case of, particularly, the above extrusion laminating method, it is possible to form a polyolefin resin layer appropriately by melt-extruding a polyolefin resin on the base paper and then by allowing the base paper to pass between an elastic roll having a nip pressure of 2 MPa or more and a cooling roll to laminate.

Specifically, there is the case where fine pores (hereinafter referred to as a "crater") are generated on the surface of the resin film laminated on the base paper. If the number of the craters is large, not only the outward appearance is damaged but also a gloss feel is reduced, whereby the product value is significantly decreased. The reason of the generation of these craters is said to be that entrained air generated when the cooling roller is rotated results in the accumulation of the entrained air between the resin film and the cooling roller to make a concaved dent in the resin film. Then, the smaller the nip pressure between the elastic roll and the cooling roll is, the higher the line speed is when laminating the resin film, the lower the thickness of the resin film is, the lower the discharge temperature of the resin from the extrusion die and the larger the surface roughness of the base paper is, the more easily the above craters are generated.

Therefore, if the nip pressure between the elastic roll and the cooling roll is set to be 2 MPa or more, the generation of craters is suppressed and therefore smooth and glossy planeness can be secured. The nip pressure is preferably 3 MPa or more and preferably has an upper limit of 8 MPa.

As the polyolefin resin to be applied to the base paper, for example, α-olefin homopolymers such as polyethylene and polypropylene, mixtures of these various polymers or random copolymers of ethylene and vinyl alcohol are preferable.

As the polyethylene, for example, LDPE (low-density polyethylene), HDPE (high-density polyethylene) and L-LDPE (straight chain low-density polyethylene) may be used either alone or by combining two or more. When polyethylene is used, those having a melt flow rate of 1.2 to 12 g/10 minutes as a value measured according to JIS 7201 are preferable.

In the case of a structure in which a polyolefin layer comprising a polyolefin (for example, polyethylene), for example, a polyethylene layer is formed, the polyethylene layer on the side of the base paper on which side the ink-receiving layer is to be formed is preferably one which is improved in non-transparency, whiteness and hue by adding rutile or anatase type titanium oxide, a fluorescent whiteness improver and a ultramarine blue pigment in the polyethylene. Here, the content of titanium oxide is preferably 3 to 20% by mass and more preferably 4 to 13% by mass based on the polyethylene.

Further, an undercoat layer may be formed for the purpose of imparting the adhesion to the ink-receiving layer serving to record an image. As the undercoat layer material, an aqueous polyester, gelatin or polyvinyl alcohol (PVA) is preferable. The thickness of the undercoat layer is preferably 0.01 to 5 μm.

The base paper according to the invention is structured as a support called the polyolefin resin coated paper (for example, polyethylene coated paper) when a part or all of the surface of the base paper on which surface the ink-receiving layer is formed is coated with polyolefin (for example, polyethylene) and may be used as gloss paper, and also as a support having a structure in which a matt surface or silky pattern surface obtained in usual photographic printing paper is formed by carrying patterning treatment when a polyolefin such as polyethylene is extruded to coat the base paper.

A backcoat layer may be formed on the surface of the base paper constituting the ink jet recording medium of the invention on the side opposite to the side on which the ink-receiving layer is to be formed. This backcoat layer may be constituted with compounding a white pigment, an aqueous binder and other components.

Examples of the white pigment that may be added to the above backcoat layer include white inorganic pigments such as light calcium carbonate, heavy calcium carbonate, kaolin, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic amorphous silica, colloidal silica, colloidal alumina, pseudo boehmite, aluminum hydroxide, alumina, lithopone, zeolite, hydrolytic halloysite, magnesium carbonate and magnesium hydroxide, and organic pigments such as a styrene type plastic pigment, acryl type plastic pigment, polyethylene, microcapsule, urea resin and melamine resin.

Examples of the aqueous binder that may be added to the backcoat layer include water-soluble polymers such as a styrene/maleate copolymer, styrene/acrylate copolymer, polyvinyl alcohol, silanol modified polyvinyl alcohol, starch, cationic starch, casein, gelatin, carboxymethyl cellulose, hydroxyethyl cellulose and polyvinylpyrrolidone and water-dispersible polymers such as a styrene butadiene latex and acryl emulsion.

Also, examples of other components that can be added to the backcoat layer may include an antifoaming agent, foam inhibitor, dyes, fluorescent whitening agent, antiseptic and water resistant agent.

Next, the structure other than the base paper constituting the ink jet recording medium will be explained in detail.

The ink jet recording medium of the invention comprises a base paper and at least one ink-receiving layer formed on the base paper and other layers according to the need.

(Ink-Receiving Layer)

The ink-receiving layer may be structured of a water-soluble resin and microparticles and preferably structured of a water-soluble resin, microparticles, a crosslinking agent capable of crosslinking the water-soluble resin, and, according the need, a mordant and other components (for example, surfactants).

The ink-receiving layer contains the microparticles, which allows the layer to have a porous structure to thereby improve ink absorbance. Particularly, when the content of a solid in the ink-receiving layer containing the microparticles is 50% by mass or more and preferably 60% by mass or more, it is possible to make better porous structure whereby the ink absorbance can be further improved. Here, the content of the solid in the ink-receiving layer of the microparticles is a content calculated based on the components except for water in the composition constituting the ink-receiving layer.

The ink-receiving layer having the above porous structure means a layer having a porosity of 50 to 75% and preferably 60 to 70%. When the above porosity is 50% or less, there is the case where the ink absorbance is insufficient, whereas when the porosity is 75% or more, there is the case where a powder-fall problem is caused by a shortage of the binder. Also, the layer thickness of the ink-receiving layer is preferably 20 to 40 μm taking the quality of the ink jet recording medium into account.

—Microparticles—

As the microparticles, both organic microparticles and inorganic microparticles may be used. Preferable examples of the above organic microparticles include polymer microparticles obtained by emulsion polymerization, micro-emulsion type polymerization, soap-free polymerization, seed polymerization, dispersion polymerization and suspension polymerization. Specific examples of these microparticles include powder, latex or emulsion polymer microparticles of, for example, polyethylene, polypropylene, polystyrene, polyacrylate, polyamide, silicone resin, phenol resin and natural polymer.

Also, examples of the inorganic microparticles include silica microparticles, colloidal silica, titanium dioxide, barium sulfate, calcium silicate, zeolite, kaolinite, halloysite, mica, talc, calcium carbonate, magnesium carbonate, calcium sulfate, pseudoboehmite, zinc oxide, zinc hydroxide, alumina, aluminum silicate, calcium silicate, magnesium silicate, zirconium oxide, zirconium hydroxide, cerium oxide, lanthanum oxide and yttrium oxide.

Among these materials, inorganic microparticles are preferable from the viewpoint of ink absorbance and image stability and silica microparticles, colloidal silica, alumina microparticles or pseudo boehmite are preferable from the viewpoint of forming a good porous structure. As the microparticles, primary particles may be used as they stand or in the state of secondary particles. The average primary particle of these microparticles is preferably 2 μm or less and more preferably 200 nm or less.

Among these materials, silica microparticles are roughly divided into wet method particles and dry method particles (vapor phase method) by a production method in usual. In the above wet method, a method is primarily used in which a silicate is decomposed by an acid to generate active silica, which is then appropriately polymerized, coagulated and settled to obtain hydrate silica. In the vapor phase method, on the other hand, a method (flame hydrolysis method) in which silicon halide is hydrolyzed at high temperature under high pressure or a method (arc method) in which quartz sand and cokes are heated and reduced by arc in an electric furnace to vaporize and the vaporized product is oxidized by air to obtain anhydrous silica is mainly used. The aforementioned "vapor phase silica" means anhydrous silica microparticles obtained by this vapor phase method. As the silica microparticles, particularly this vapor phase method silica microparticles are preferable.

The vapor phase method silica is different from the hydrate silica in, for example, the density of a silanol group on the surface and whether voids are present or not and exhibits natures different from those of hydrate silica. However, the vapor phase silica is preferable to form a three-dimensional structure having a high porosity. Although this reason is not clarified, it is inferred that in the case of hydrate silica, the density of a silanol group on the surface of the microparticles is as many as 5 to 8 groups/$nm^2$, and therefore the silica microparticles are easily aggregated densely whereas in the vapor phase method silica, the density of a silanol group on the surface of microparticles is 2 to 3 groups/$nm^2$, and therefore, silica microparticles become a rough soft flocculate, with the result that the vapor phase method silica forms a structure having a high porosity.

The aforementioned vapor phase method silica has the characteristics that it is improved in ink absorbance and ink retaining efficiency and has a low refractive index because it has a particularly large specific surface area and if it is dispersed until it has a proper particle diameter, transparency can be imparted to the receptor layer and a high color density and sufficient color developing ability can be obtained because it has a low refractive index. The fact that the receptor layer is transparent is important from the viewpoint of obtaining a highly developed color density and sufficiently developed color gloss not only in applications, such as OHPs, which need transparency, but also in the case of applying the medium to recording mediums such as photo-gloss paper.

The average primary particle diameter of the above vapor phase method silica is 30 nm or less, preferably 20 nm or less, particularly preferably 10 nm or less and most preferably 3 to 10 nm. The vapor phase method silica can form a structure having a large porosity when the average primary particle diameter is 30 nm or less whereby the ink absorbance can be improved efficiently because particles are easily stuck to each other by a hydrogen bond due to a silanol group.

Also, the silica microparticles may be used in combination with the aforementioned other microparticles. When these other microparticles are combined with the above vapor phase method silica, the content of the vapor phase method silica in all microparticles is preferably 30% by mass or more and more preferably 50% by mass or more.

As the above inorganic microparticles, alumina microparticles, alumina hydrate and a mixture or compounds of these materials are also preferable. Among these materials, an alumina hydrate is preferable because it well absorbs and fixes ink and particularly pseudo-boehmite ($Al_2O_3.nH_2O$) is preferable. As the alumina hydrate, various types may be used. However, sol-like boehmite is preferably used as a raw material because a smooth layer is obtained with ease.

As to the porous structure of pseudo-boehmite, the average pore radius is preferably 1 to 25 nm and more preferably 2 to 10 nm. Also, the pore volume is preferably 0.3 to 2.0 ml/g and more preferably 0.5 to 1.5 ml/g. Here, the pore radius and the pore volume are measured by a nitrogen adsorbing/desorbing method and specifically measured using a gas desorbing analyzer (for example, trade name: "Omnisoap 369", manufactured by Coulter Company).

Also, among the alumina microparticles, vapor phase method alumina microparticles have a large specific surface area and are hence preferable. The average primary particle diameter of the vapor phase method alumina is preferably 50 nm or less and more preferably 20 nm or less. Colloidal silica having an average primary particle diameter of 50 nm or less is also given as preferable examples.

As the aforementioned microparticles, any type disclosed in, for example, each publication of JP-A Nos. 10-81064, 10-119423, 10-157277, 10-217601, 11-348409, 2001-138621, 2000-43401, 2000-211235, 2000-309157, 2001-96897, 2001-138627, 11-91242, 8-2087, 8-2090, 8-2091, 8-2093, 8-174992, 11-192777 and 2001-301314 may also be used.

—Water-Soluble Resins—

The aforementioned ink-receiving layer preferably contains a water-soluble resin. Examples of the water-soluble resin include polyvinyl alcohol (type) resins which are resins having a hydroxy group as a hydrophilic structural unit (for example, polyvinyl alcohol (PVA), acetoacetyl-modified polyvinyl alcohol, cation-modified polyvinyl alcohol, anion-modified polyvinyl alcohol, silanol-modified polyvinyl alcohol and polyvinylacetal), cellulose type resins (for example, methyl cellulose (MC), ethyl cellulose (EC), hydroxyethyl cellulose (HEC), carboxymethyl cellulose (CMC), hydroxypropyl cellulose (HPC), hydroxyethylmethyl cellulose and hydroxypropylmethyl cellulose), Chitins, chitosans, starch, resins having an ether bond (for example, polyethylene oxide (PEO), polypropylene oxide (PPO), polyethylene glycol (PEG) and polyvinyl ether (PVE)) and resins having a carbamoyl group (for example, polyacrylamide (PAAM), polyvinylpyrrolidone (PVP) and hydrazide polyacrylate). Among these compounds, polyvinyl alcohol type resins, cellulose type resins, resins having an ether bond, resins having a carbamoyl group, resins having a carboxy group and gelatins are preferable.

Also, polyacrylates, maleic acid resins, alginate and gelatins, which all have a carboxyl group as a dissociable group, may also be exemplified.

Among the above compounds, particularly polyvinyl alcohol type resins are preferable. Examples of the polyvinyl alcohol include those described in, for example, Japanese Patent Publication (P-B) Nos. 4-52786, 5-67432 and 7-29479, JP No. 2537827, JP-B No. 7-57553, JP Nos. 2502998 and 3053231, JP-A No. 63-176173, JP No. 2604367, JP-A Nos. 7-276787, 9-207425, 11-58941, 2000-135858, 2001-205924, 2001-287444, 62-278080, 9-39373, JP No. 2750433, JP-A Nos. 2000-158801, 2001-213045, 2001-328345, 8-324105 and 11-348417.

These water-soluble resins may be used either alone or in combinations of two or more. The content of the above water-soluble resin is preferably 9 to 40% by mass and more preferably 12 to 33% by mass based on the mass of all solid in the ink-receiving layer.

The above water-soluble resin and microparticles, which mainly constitute the ink-receiving layer of the ink jet recording medium, may be respectively an alone material or may use a mixture type of plural materials.

The type of water-soluble resin to be combined with the microparticles, particularly, the silica microparticles is important from the viewpoint of retaining transparency. When the above vapor phase method silica is used, polyvinyl alcohol (type) resins are preferable as the water-soluble resin. Among these resins, polyvinyl alcohol (type) resins having a saponification value of 70 to 100% are more preferable and polyvinyl alcohol (type) resins having a saponification value of 80 to 99.5% are particularly preferable.

The above polyvinyl alcohol (type) resin has a hydroxyl group in its structural units. Because this hydroxyl group and a surface silanol group of the above silica microparticles form a hydrogen bond, a three-dimensional network structure in which secondary particles of the silica microparticles form network chain units is easily formed. It is considered that the formation of this three-dimensional structure ensures the formation of the ink-receiving layer having a porous structure having a high porosity and sufficient strength.

In ink jet recording, the porous ink-receiving layer obtained in the above manner absorbs ink rapidly by a capillary phenomenon to form favorable dots that have a true-circularity and are free from ink bleeding.

Also, the polyvinyl alcohol (type) resin may be used in combination with the above other water-soluble resins. When these other resins and the above polyvinyl alcohol (type) resin are used together, the content of the polyvinyl alcohol (type) resin in all water-soluble resins is preferably 50% by mass or more and more preferably 70% by mass or more.

<Ratio of the Microparticles to the Water-Soluble Resin>

The ratio by mass [PB ratio=x/y] of the mass "x" of the microparticles to the mass "y" of the water-soluble resin largely affects the layer structure and layer strength of the ink-receiving layer. Specifically, when the weight ratio (PB ratio) is increased, the density and strength tend to decrease though the porosity, pore volume, and surface area (per unit mass) are increased.

The above PB ratio (x/y) in the ink-receiving layer is preferably 1.5 to 10 from the viewpoint of preventing defects caused by excessive large PB ratio, for example, a reduction in layer strength and the generation of cracks during drying and defects caused by excessive small PB ratio, for example, a reduction in ink absorbance which reduction is caused by reduced porosity because the voids are easily clogged by the resin.

Also, there may be the case where pressure is applied to the ink jet recording medium when it is passed through a carrying system and therefore the ink-receiving layer must have sufficient layer strength. It is also necessary that the ink-receiving layer has sufficient layer strength from the viewpoint of preventing the ink-receiving layer from being cracked and peeled off in the case of cutting the medium into sheets. Taking these facts into account, the above PB ratio is preferably 5 or less whereas the PB ratio is more preferably 2 or more from the viewpoint of ensuring high speed ink absorbance.

For example, when a coating solution obtained by dispersing the vapor phase method silica microparticles having an average primary particle diameter of 20 mm or less and the water-soluble resin in a P/B ratio (x/y) of 2 to 5 completely in an aqueous solution is applied to the support and dried, a three-dimensional network structure in which secondary particles of the silica microparticles form network chain units is formed, making it possible to form a translucent porous film having an average pore diameter of 25 nm or less, a porosity of 50 to 80%, a pore specific volume of 0.5 ml/g or more and a specific surface area of 100 $m^2/g$ or more with ease.

—Crosslinking Agent—

The above ink-receiving layer preferably has the characteristics that the coating layer containing the microparticles and the water-soluble resins further contains a crosslinking agent capable of crosslinking the water-soluble resin and is a porous layer cured by a crosslinking reaction between the crosslinking agent and the water-soluble resin.

To crosslink the aforementioned water-soluble resin, particularly, a polyvinyl alcohol type resin, a boron compound is preferable. Examples of the boron compound may include borax, boric acid, borates (for example, orthoborates, $InBO_3$, $ScBO_3$, $YBO_3$, $LaBO_3$, $Mg_3(BO_3)_2$, $CO_3(BO_3)_2$, diborates (for example, $Mg_2B_2O_5$ and $CO_2B_2O_5$), methaborates (for example, $LiBO_2$, $Ca(BO_2)_2$, $NaBO_2$ and $KBO_2$), tetraborates (for example, $Na_2B_4O_7.10H_2O$) and pentaborates (for example, $KB_5O_8.4H_2O$ and $CsB_5O_5$)) and $Ca_2B_6O_{11}.7H_2O$. Among these compounds, borax, boric acid, and borates are preferable and boric acid is particularly preferable in the point that these compounds can cause a crosslinking reaction rapidly.

As the above crosslinking agent for the water-soluble resin, besides the boron compounds, the following compounds may be used.

Examples of the crosslinking agent include aldehyde type compounds such as formaldehyde, glyoxal and glutaraldehyde; ketone type compounds such as diacetyl and cyclopentanedione; active halogen compounds such as bis(2-chloroethylurea)-2-hydroxy-4,6-dichloro-1,3,5-triazine and 2,4-dichloro-6-S-triazine sodium salt; active vinyl compounds such as divinylsulfonic acid, 1,3-vinylsulfonyl-2-propanol, N,N'-ethylenebis(vinylsulfonylacetamide), 1,3,5-triacryloylhexahydro-S-triazine; N-methylol compounds such as dimethylolurea and methylol dimethylhydantoin, melamine resins (for example, methylolmelamine and alkylated methylol melamine); epoxy resins; isocyanate type compounds such as 1,6-hexamethylenediisocyanate; aziridine type compounds described in the specification of U.S. Pat. Nos. 3,017,280 and 2,983,611; carboxyimide type compounds described in the specification of U.S. Pat. No. 3,100,704; epoxy type compounds such as glycerol triglycidyl ether; ethyleneimino type compounds such as 1,6-hexamethylene-N,N'-bisethyleneurea; halogenated carboxyaldehyde type compounds such as mucochloric acid and mucophenoxychloric acid; dioxane type compounds such as 2,3-dihydroxydioxane; metal-containing compounds such as titanium lactate, aluminum sulfate, chrome alum, potassium alum, zirconium acetate and chromium acetate; polyamine compounds such as tetraethylenepentamine; and hydrazide compounds such as dihydrazide adipate; and low-molecular materials or polymers having two or more oxazoline groups.

The above crosslinking agents may be used either alone or in combinations of two or more.

The crosslinking and curing are preferably carried out in the following manner: a crosslinking agent is added to a coating solution (hereinafter also referred to as "ink-receiving layer coating solution" or "first solution") that contains the microparticles and the water-soluble resin and is used to form the ink-receiving layer and/or the following basic solution, and the basic solution (hereinafter referred to also as "second solution") having a pH of 7.1 or more is applied to the above coating layer (1) at the same time when the above first solution is applied to form a coating layer or (2) during the course of drying the coating layer formed by applying the first solution and before the coating layer exhibits falling-drying.

The crosslinking agent is preferably added in the following manner when a boron compound is taken as an example. Specifically, when the ink-receiving layer is a layer formed by applying the coating solution (first solution) containing the microparticles and the water-soluble resin containing a polyvinyl alcohol to form a coating layer, which is then crosslinked and cured, the crosslinking and curing are carried out by applying the basic solution (second solution) having a pH of 7.1 or more to the above coating layer (1) at the same time when the above first solution is applied to form a coating layer or (2) during the course of drying the coating layer formed by applying the first solution and before the coating layer exhibits falling-drying. The boron compound as the crosslinking agent may be contained in either the first solution or the second solution or in both the first and second solutions.

The amount of the crosslinking agent to be used is preferably 1 to 50% by mass and more preferably 5 to 40% by mass based on the water-soluble resin.

—Mordant—

In the invention, the ink-receiving layer preferably contains a mordant to more improve the water resistance of a formed image and a resistance to bleeding with time. As the mordant, organic mordants such as cationic polymers (cationic mordants) and inorganic mordants such as water-soluble metal compounds may be both used. Among these mordants, organic mordants are preferable and cationic mordants are particularly preferable.

By making the above mordant present in at least the upper layer part of the ink-receiving layer, the mordant interacts with liquid ink containing an anionic dye as a colorant to thereby stabilize the colorant, whereby the water resistance and the bleeding with time can be further improved.

In this case, the mordant is preferably used by compounding it in the second solution which is different from a solution containing the inorganic microparticles (particularly, vapor phase method silica) though it may be added in either or both of the ink-receiving layer coating solution (first solution) and the basic solution (second solution). Specifically, if the mordant is added directly to the ink-receiving layer coating solution, there is the case where aggregation occurs under the coexistence of vapor phase method silica having an anionic charge. However, if a method is adopted in which the solution containing the mordant and the ink-receiving layer coating solution are respectively prepared and are respectively applied, it is not necessary to take the aggregation of the inorganic microparticles into account and therefore the range of the selection of the mordant becomes wider.

As the above cationic mordant, a polymer mordant having a primary to tertiary amino group or a quaternary ammonium salt group as a cationic functional group is preferably used. However, a cationic non-polymer mordant may also be used.

As the above polymer mordant, a homopolymer of a monomer (hereinafter referred to as "mordant monomer") having a primary to tertiary amino group or its salt or a monomer having a quaternary ammonium salt group or a copolymer or condensed polymer of the mordant monomer and other monomers (hereinafter referred to as "non-mordant monomer") is preferable. These polymer mordants may be used in any form of a water-soluble polymer or water-soluble latex particles.

Examples of the above mordant monomer include trimethyl-p-vinylbenzyl ammonium chloride, trimethyl-m-vinylbenzyl ammonium chloride, triethyl-p-vinylbenzyl ammonium chloride, triethyl-m-vinylbenzyl ammonium chloride, N,N-dimethyl-N-ethyl-N-p-vinylbenzyl ammonium chloride, N,N-diethyl-N-methyl-N-p-vinylbenzyl ammonium chloride, N,N-dimethyl-N-n-propyl-N-p-vinylbenzyl ammonium chloride, N,N-dimethyl-N-n-octyl-N-p-vinylbenzyl ammonium chloride, N,N-dimethyl-N-benzyl-N-p-vinylbenzyl ammonium chloride, N,N-diethyl-N-benzyl-N-p-vinylbenzyl ammonium chloride, N,N-dimethyl-N-(4-methyl)benzyl-N-p-vinylbenzyl ammonium chloride, N,N-dimethyl-N-phenyl-N-p-vinylbenzyl ammonium chloride; trimethyl-p-vinylbenzyl ammonium bromide, trimethyl-m-vinylbenzyl ammonium bromide, trimethyl-p-vinylbenzyl ammonium sulfonate, trimethyl-m-vinylbenzyl ammonium sulfonate, trimethyl-p-vinylbenzyl ammonium acetate, trimethyl-m-vinylbenzyl ammonium acetate, N,N,N-triethyl-N-2-(4-vinylphenyl)ethyl ammonium chloride, N,N,N-triethyl-N-2-(3-vinylphenyl)ethyl ammonium chloride, N,N-diethyl-N-methyl-N-2-(4-vinylphenyl)ethyl ammonium chloride, N,N-diethyl-N-methyl-N-2-(4-vinylphenyl)ethyl ammonium acetate; quaternary products of methyl chloride, ethyl chloride, methyl bromide, ethyl bromide, methyl iodide or ethyl iodide, or sulfonates, alkylsulfonates, acetates or alkylcarboxylates obtained by substituting each anion of these quaternary products of N,N-dimethylaminoethyl (meth)acrylate, N,N-diethylaminoethyl(meth)acrylate, N,N-dimethylaminopropyl (meth)acrylate, N,N-diethylaminopropyl (meth)acrylate, N,N-dimethylaminoethyl (meth)acrylamide, N,N-diethylaminoethyl(meth)acrylamide, N,N-dimethylaminopropyl (meth)acrylamide or N,N-diethylaminopropyl (meth)acrylamide.

Specific examples may include monomethyldiallyl ammonium chloride, trimethyl-2-(methacryloyloxy)ethyl ammonium chloride, triethyl-2-(methacryloyloxy)ethyl ammonium chloride, trimethyl-2-(acryloyloxy)ethyl ammonium chloride, triethyl-2-(acryloyloxy)ethyl ammonium chloride, trimethyl-3-(methacryloyloxy)propyl ammonium chloride, triethyl-3-(methacryloyloxy)propyl ammonium chloride, trimethyl-2-(methacryloylamino)ethyl ammonium chloride, triethyl-2-(methacryloylamino)ethyl ammonium chloride, trimethyl-2-(acryloylamino)ethyl ammonium chloride, triethyl-2-(acryloylamino)ethyl ammonium chloride, trimethyl-3-(methacryloylamino)propyl ammonium chloride, triethyl-3-(methacryloylamino)propyl ammonium chloride, trimethyl-3-(acryloylamino)propyl ammonium chloride, triethyl-3-(acryloylamino)propyl ammonium chloride; N,N-dimethyl-N-ethyl-2-(methacryloyloxy)ethyl ammonium chloride, N,N-diethyl-N-methyl-2-(methacryloyloxy)ethyl ammonium chloride, N,N-dimethyl-N-ethyl-3-(acryloylamino)propyl ammonium chloride, trimethyl-2-(methacryloyloxy)ethyl ammonium bromide, trimethyl-3-(acryloylamino)propyl ammonium bromide, trimethyl-2-(methacryloyloxy)ethyl ammonium sulfonate and trimethyl-3-(acryloylamino)propyl ammonium acetate.

Examples of copolymerizable monomers other than the above monomers include N-vinylimidazole and N-vinyl-2-methylimidazole.

Also, allylamine and diallylamine and their derivatives or salts may be utilized. Examples of such a compound include an allylamine, allylamine hydrochloride, allylamine acetate, allylamine sulfate, diallylamine, diallylamine hydrochloride, diallylamine acetate, diallylamine sulfate, diallylmethylamine and its salts (for example, hydrochlorides, acetates or sulfates as the salts), diallylethylamine and its salts (for example, hydrochlorides, acetates or sulfates as the salts) and diallyldimethylammonium salts (for example, chlorides, or acetic acid ion or sulfuric acid ion as the counter anion of these salts). These allylamines and diallylamine derivatives are inferior in polymerizing ability in the form of an amine. Therefore, in usual methods, these amine or derivatives are converted into salts, which are then polymerized, and the polymerized products are, as required, desalted.

Also, a vinylamine unit obtained by using a polymer unit such as N-vinylacetamide or N-vinylformamide, and polymerizing this polymer unit to form a polymer, which is then hydrolyzed or a salt of the vinylamine may also be utilized.

The above non-mordant monomer means a monomer that does not contain a primary to tertiary amino group and its salt or a basic or cationic part such as a quaternary ammonium salt group and has no or substantially small interaction with dyes in ink jet ink.

Specific examples of the above non-mordant monomer include alkyl (meth)acrylates; cycloalkyl(meth)acrylates such as cyclohexyl(meth)acrylate; aryl (meth)acrylates such as phenyl(meth)acrylate; aralkyl esters such as benzyl (meth) acrylate; aromatic vinyls such as styrene, vinyltoluene and α-methylstyrene; vinyl esters such as vinyl acetate, vinyl propionate and vinyl versatic acid esters; allyl ester such as allyl acetate; halogen-containing monomers such as vinylidene chloride, vinyl chloride; vinylcyanates such as (meth)acrylonitrile; and olefins such as ethylene and propylene.

As the above alkyl(meth)acrylate, alkyl(meth)acrylates provided with an alkyl part having 1 to 18 carbon atoms are preferable. Examples of these alkyl(meth)acrylates include methyl(meth)acrylate, ethyl(meth)acrylate, propyl(meth) acrylate, isopropyl (meth)acrylate, n-butyl(meth)acrylate, isobutyl(meth)acrylate, t-butyl(meth)acrylate, hexyl(meth) acrylate, octyl(meth)acrylate, 2-ethylhexyl(meth)acrylate, lauryl (meth)acrylate and stearyl(meth)acrylate. Among these compounds, methyl acrylate, ethyl acrylate, methyl methacrylate, ethyl methacrylate and hydroxyethyl methacrylate are preferable. The above non-mordant monomers may be used either alone or in combinations of two or more.

Moreover, preferable examples of the cationic mordant may include polydiallyldimethyl ammonium chloride, polymethacryloyloxyethyl-β-hydroxyethyldimethyl ammonium chloride, polyethyleneimine, polyallylamine and its derivatives, polyamide-polyamine resins, cationic starch, dicyandiamide-formalin condensate, dimethyl-2-hydroxypropylammonium salt polymers, polyamidine, polyvinylamine, dicyan type cationic resins represented by a dicyandiamide-formalin polymerization condensate, polyamine type cationic resins represented by a dicyanamide-diethylenetriamine polymerization condensate, epichlorohydrin-dimethylamine-addition polymers, dimethyldiallylammonium chloride-$SO_2$ copolymers, diallylamine salt-$SO_2$ copolymers, (meth)acrylate-containing polymers having a quaternary ammonium salt group substituted alkyl group at the ester part and styryl type polymers having a quaternary ammonium salt group substituted alkyl group.

Examples of the above cationic mordant include those described in each publication of JP-A Nos. 48-28325, 54-74430, 54-124726, 55-22766, 55-142339, 60-23850, 60-23851, 60-23852, 60-23853, 60-57836, 60-60643, 60-118834, 60-122940, 60-122941, 60-122942, 60-235134 and 1-161236, each specification of U.S. Pat. Nos. 2,484,430, 2,548,564, 3,148,061, 3,309,690, 4,115,124, 4,124,386, 4,193,800, 4,273,853, 4,282,305 and 4,450,224, each publication of JP-A Nos. 1-161236, 10-81064, 10-119423, 10-157277, 10-217601, 11-348409, 2001-138621, 2000-43401, 2000-211235, 2000-309157, 2001-96897, 2001-138627, 11-91242, 8-2087, 8-2090, 8-2091, 8-2093, 8-174992, 11-192777 and 2001-301314, JP-B Nos. 5-35162, 5-35163, 5-35164, 5-88846, 7-118333 and 2000-344990 and each specification of JP Nos. 2648847 and 2661677. Among these cationic mordants, polyallylamine and its derivatives are preferable and a diallyldialkyl cationic polymer is structurally preferable.

As the above polyallylamine or its derivatives, various known allylamine polymers and their derivatives may be used. Examples of these derivatives include salts of polyallylamine and acids (the acids are, for example, inorganic acids such as hydrochloric acid, sulfuric acid, phosphoric acid and nitric acid and organic acids such as methanesulfonic acid, toluenesulfonic acid, acetic acid, propionic acid, cinnamic acid and (meth)acrylic acid) or combinations of these salts and those which are salts of only a part of polyallylamine and acids, derivatives obtained by a high-molecular reaction of polyallylamine and copolymers of polyallylamine and other copolymerizable monomers (specific examples of the other monomers include (meth)acrylates, styrenes, (meth)acrylamides, acrylonitrile and vinyl esters).

Specific examples of the polyallylamine and its derivatives include each publication of JP-B Nos. 62-31722, 2-14364, 63-43402, 63-43403, 63-45721, 63-29881, 1-26362, 2-56365, 2-57084, 4-41686, 6-2780, 6-45649, 6-15592 and 4-68622, JP Nos. 3199227 and 3008369, JP-A Nos. 10-330427, 11-21321, 2000-281728, 2001-106736, 62-256801, 7-173286, 7-213897, 9-235318, 9-302026 and 11-21321, WO99/21901, WO99/19372, JP-A No. 5-140213 and Japanese Patent Application National Publication (Laid-Open) No. 11-506488.

Among the above cationic mordants, a diallyldialkyl cationic polymer is preferable and particularly, diallyldimethyl cationic polymer is preferable. Also, the cationic mordant is preferably a cationic polymer having a weight average molecular weight of 60,000 or less and particularly 40,000 or less from the viewpoint of dispersibility and, particularly prevention of thickening.

The cationic mordant is also useful as the dispersant of the aforementioned microparticles.

When the mordant is added to the ink-receiving layer coating solution, the concentration of sulfuric acid ions in the coating solution is preferably 1.5% by mass to prevent the solution to be thickened. These sulfuric acid ions are contained in, for example, an initiator used in the production of the cationic polymer and is left in the polymer. It is therefore preferable to use a cationic mordant produced using, for example, an initiator releasing no sulfuric acid ion.

Examples of the inorganic mordant include polyvalent water-soluble metal salts and hydrophobic metal salt compounds. Specific examples of these inorganic mordants include salts or complexes of metals selected from magnesium, aluminum, calcium, scandium, titanium, vanadium, manganese, iron, nickel, copper, zinc, gallium, germanium, strontium, yttrium, zirconium, molybdenum, indium, barium, lanthanum, cerium, praseodymium, neodymium, samarium, europium, gadolinium, dysprosium, erbium, ytterbium, hafnium, tungsten and bismuth.

Specific examples of the inorganic mordant include calcium acetate, calcium chloride, calcium formate, calcium sulfate, barium acetate, barium sulfate, barium phosphate, manganese chloride, manganese acetate, manganese formate dihydrate, ammonium manganese sulfate hexahydrate, cupric chloride, ammonium copper (II) chloride dihydrate, copper sulfate, cobalt chloride, cobalt thiocyanate, cobalt sulfate, nickel sulfate hexahydrate, nickel chloride hexahydrate, nickel acetate tetrahydrate, ammonium nickel sulfate hexahydrate, nickel amidosufate tetrahydrate, aluminum sulfate, aluminum alum, basic aluminum polyhydroxide, aluminum sulfite, aluminum thiosulfate, aluminum polychloride, aluminum nitrate nonahydrate, aluminum chloride hexahydrate, ferrous bromide, ferrous chloride, ferric chloride, ferrous sulfate, ferric sulfate, zinc phenolsulfonate, zinc bromide, zinc chloride, zinc nitrate hexahydrate, zinc sulfate, titanium tetrachloride, tetraisopropyl titanate, titanium acetylacetonate, titanium lactate, zirconium acetylacetonate, zirconium acetate, zirconium sulfate, ammonium zirconium carbonate, zirconium stearate, zirconium octylate, zirconium nitrate, zirconium oxychloride, zirconium hydroxychloride, chromium acetate, chromium sulfate, magnesium sulfate, magnesium chloride hexahydrate, magnesium citrate nonahydrate, sodium phosphorous tungstate, sodium tungsten citrate, 12-tungstophosphoric acid n-hydrate, 12-tungstosilicic acid 26-hydrate, molybdenum chloride, 12-molybdophosphoric acid n-hydrate, gallium nitrate, germanium nitrate, strontium nitrate, yttrium acetate, yttrium chloride, yttrium nitrate, indium nitrate, lanthanum nitrate, lanthanum chloride, lanthanum acetate, lanthanum benzoate, cerium chloride, cerium sulfate, cerium octylate, praseodymium nitrate, neodymium nitrate, samarium nitrate, europium nitrate, gadolinium nitrate, dysprosium nitrate, erbium nitrate, ytterbium nitrate, hafnium chloride and bismuth nitrate.

Among these inorganic mordants, aluminum-containing compounds, titanium-containing compounds, zirconium-containing compounds and compounds (salts or complexes) of metals of the IIIB group in the periodic chart are preferable.

The amount of the above mordant to be added in the ink-receiving layer is preferably 0.01 to 5 g/m$^2$ and more preferably 0.1 to 3 g/m$^2$.

—Other Components—

The ink-receiving layer or the coating solution for forming the ink-receiving layer (ink-receiving layer coating solution) may be compounded of, besides the aforementioned components, various known additives, for example, an ultraviolet ray absorber, antioxidant, fluorescent whitening agent, monomer, polymerization initiator, polymerization inhibitor, bleeding preventive, antiseptic, viscosity stabilizer, antifoaming agent, surfactants, antistatic agent, matt agent, curling preventive and water resistive agent according to the need.

Other components may be used either alone or in combinations of two or more. These other components may be added in the form of water-soluble state, polymer dispersion, emulsion, or oil droplets or after made into a microcapsule. The amount of these other components to be added is preferably 0.01 to 10 g/m$^2$.

Also, the surface of the inorganic microparticles may be treated with a silane coupling agent with the intention of improving the dispersibility of the inorganic microparticles. As the silane coupling agent, those having an organic functional group (for example, a vinyl group, amino group, epoxy group, mercapto group, chloro group, alkyl group, phenyl group or ester group) besides the part working for coupling treatment are preferable.

In the invention, the ink-receiving layer coating solution preferably contains a surfactant in a preferred form. The surfactant, here, includes a cationic type, anionic type, nonionic type, amphoteric type, fluorine type and silicone type surfactants.

Examples of the above nonionic surfactant include polyoxyalkylene alkyl ether and polyoxyalkylene alkylphenyl ethers (e.g., diethylene glycol monoethyl ether, diethylene glycol diethyl ether, polyoxyethylene lauryl ether, polyoxyethylene stearyl ether and polyoxyethylene nonylphenyl ether), oxyethylene/oxypropylene block copolymer, sorbitan fatty acid esters (e.g., sorbitan monolaurate, sorbitan monooleate and sorbitan trioleate), polyoxyethylenesorbitan fatty acid esters (e.g., polyoxyethylenesorbitan monolaurate, polyoxyethylenesorbitan monooleate and polyoxyethylenesorbitan trioleate), polyoxyethylenesorbitol fatty acid esters (e.g., polyoxyethylene sorbitol tetraoleate), glycerin fatty acid esters (e.g., glycerol monooleate), polyoxyethyleneglycerin fatty acid esters (e.g., polyoxyethyleneglycerin monostearate and polyoxyethyleneglycerin monooleate), polyoxyethylene fatty acid esters (polyethyleneglycol monolaurate and polyethylene glycol monooleate), polyoxyethylenealkylamine and acetylene glycols (e.g., 2,4,7,9-tetramethyl-5-decyne-4,7-diol and ethylene oxide adduct or propylene oxide adduct of the diol). Polyoxyalkylene alkyl ethers are preferable. The nonionic surfactant may be contained in the ink-receiving layer coating solution.

Examples of the above amphoteric surfactant include an amino acid type, carboxyammonium betaine type, sulfoneammonium betaine type, ammonium sulfate ester betaine type and imidazolium betaine type. For example, as the amphoteric surfactant, those described in the specification of U.S. Pat. No. 3,843,368, and each publication of JP-A Nos. 5949535, 63-236546, 5-303205, 8-262742 and 10-282619 may be preferably used. As the amphoteric surfactant, an amino acid type amphoteric surfactant is preferable. Examples of the amino acid type amphoteric surfactant include N-aminoacyl acid, which is derived from amino acids (for example, glycine, glutamic acid and histidic acid) and provided with a long-chain acyl group introduced thereinto and its salts as described in the publication of JP-A No. 5-303205.

Examples of the above anionic surfactant include fatty acid salts (for example, sodium stearate and potassium oleate), alkyl sulfates (for example, sodium lauryl sulfate and triethanolamine lauryl sulfate), sulfonates (for example, sodium dodecylbenzenesulfonate), alkylsulfosuccinate (for example, sodium dioctylsulfosuccinate), alkyl diphenyl ether disulfonate and alkyl phosphate.

Examples of the above cationic surfactant include alkylamine salts, quaternary ammonium salts, pyridinium salts and imidazolium salts.

Examples of the fluorine type surfactant include compounds derived through an intermediate having a perfluoroalkyl group by using methods such as electrolytic fluorination, telomerization and oligomerization. Examples of the fluorine type surfactant include a perfluoroalkyl sulfonate, perfluoroalkyl carboxylate, perfluoroalkyl ethyleneoxide adduct, perfluoroalkyltrialkyl ammonium salt, perfluoroalkyl group-containing oligomer and perfluoroalkyl phosphate.

As the aforementioned silicone type surfactant, silicone oil modified using an organic group is preferable. The silicone type surfactant may take structures in which the side chain, both of the terminals or one terminal of a siloxane structure is (are) modified by an organic group. Examples of the organic group-modification include amino-modification, polyether-modification, epoxy-modification, carboxyl-modification, carbinol-modification, alkyl-modification, aralkyl-modification, phenol-modification and fluorine-modification.

The total amount of the surfactant in the ink-receiving layer coating solution is preferably 0.001 to 2.0% by mass and more preferably 0.01 to 1.0% by mass.

The ink-receiving layer is preferably formed by a method (Wet-on-Wet method) in which a coating solution containing the microparticles and the water-soluble resin is applied to the surface of the support to form a coating layer, further a crosslinking agent is added to the above coating solution and/or the following basic solution, and the basic solution having a pH of 7.1 or more is applied to the above coating layer (1) at the same time when the above coating solution is applied to form a coating layer or (2) during the course of drying the coating layer formed by applying the coating solution and before the coating layer exhibits falling-drying, to crosslink and cure the coating solution. Here, the crosslinking agent capable of curing the water-soluble resin is preferably contained in at least one of the coating solution or the basic solution or in both solutions. The formation of the ink-receiving layer crosslinked and cured in the above manner is preferable from the viewpoint of ink absorbance and preventing cracks of the layer.

The above mordant is preferably made to exist such that the thickness of the mordant existing part formed on the surface of the receptor layer is 10 to 60% the thickness of the receptor layer. The mordant layer may be formed using a desired method: for example, (1) a method in which a coating layer containing the above microparticles, water-soluble resin and crosslinking agent is formed and a mordant-containing solution is applied to the coating layer and (2) a method in which a coating solution containing the microparticles and water-soluble resin and a mordant-containing solution are applied as a multilayer. Also, the mordant-containing solution may contain the inorganic microparticles, the water-soluble resin and the crosslinking agent.

The above structure is preferable because it allows a lot of the mordant present in a fixed part and therefore, the colorant of ink jet ink is sufficiently mordanted, whereby color density, bleeding with time, gloss of a printing part, and the water resistance and ozone resistance of characters and an image obtained after printing are improved. A part of the mordant may be contained in a layer formed first on the support. In this case, the remainder mordant to be added later may be the same as or different from the first blended mordant.

In the invention, the ink-receiving layer coating solution (first solution) containing the microparticles (for example, vapor phase method silica) and the water-soluble resin (for example, polyvinyl alcohol) may be prepared in the following manner.

Specifically, microparticles such as vapor phase method silica are added together with a dispersant in water (for example, the concentration of these silica microparticles is 10 to 20% by mass), the mixture is pre dispersed (primarily dispersion) using, for example, a homomixer, in succession, the obtained dispersion solution is dispersed (secondarily dispersion) using a dispersing machine such as ALTIMIZER (manufactured by Sugino Machine Limited) by one pass, and then, an aqueous polyvinyl alcohol (PVA) solution is added to the solution (for example, such that the amount of PVA is about ⅓ the mass of the vapor phase method silica), whereby the ink-receiving layer coating solution can be prepared. It is preferable to adjust the coating solution to pH about 9.2 by using aqueous ammonia or the like or to use a dispersant to impart stability to the solution. The resulting coating solution has a uniform sol state. A porous ink-receiving layer having a three-dimensional network structure can be obtained by applying this coating solution to the support by the following coating method followed by drying.

As the dispersing machine used for the above dispersion treatment, conventionally known various dispersing machines such as a colloid mill dispersing machine, high-speed dispersing machine, medium stirring type dispersing machine (for example, a ball mill and sand mill), ultrasonic dispersing machine and high-pressure dispersing machine may be used. Among these dispersing machines, an ultrasonic dispersing machine and high-pressure dispersing machine (particularly, a high-pressure jet dispersing machine) are preferable from the point of efficiently dispersing pilled microparticles to be formed.

Also, as a solvent in each step, water, organic solvents or mixed solvents of these solvents may be used. Examples of the organic solvent used for this coating operation include alcohols such as methanol, ethanol, n-propanol, i-propanol and methoxypropanol, ketones such as acetone and methyl ethyl ketone, tetrahydrofuran, acetonitrile, ethyl acetate and toluene.

A cationic polymer may be used as the aforementioned dispersant. Examples of the cationic polymer include those given as the examples of the above mordant. Also, a silane coupling agent is preferably used as the dispersant.

The amount of the dispersant to be added is 0.1 to 30% by mass and more preferably 1 to 10% by mass based on the microparticles.

The ink-receiving layer coating solution may be applied by a known coating method using, for example, an extrusion die coater, air doctor coater, blade coater, rod coater, knife coater, squeeze coater, reverse roll coater or bar coater.

When or before the ink-receiving layer coating solution (first solution) is applied to form a coating layer, the basic solution (second solution) is applied to the coating solution. In this case, the second solution may be applied before the coating layer exhibits falling-drying. Specifically, the ink-receiving layer is properly produced by introducing the second solution before the coating layer exhibits constant-rate-drying after the ink-receiving layer coating solution (first solution) is applied. The second solution is made to contain a mordant.

Here, the description "before the coating layer exhibits falling-drying" indicates a process for a few minutes just after the ink-receiving layer coating solution is applied. During this process, the coating layer shows a "constant-rate-drying" phenomenon that the content of a solvent (dispersion medium) in the coating layer to be applied decreases in proportion to time. The time showing this "constant-rate-drying" is described in "CHEMICAL ENGINNERING HANDBOOK" (pp. 707-712, Maruzen, Oct. 25 (1980)).

As mentioned above, after the first solution is applied, the coating layer is dried until the coating layer exhibits the falling-drying. This drying is carried out generally at 40 to 180° C. for 0.5 to 10 minutes (preferably 0.5 to 5 minutes). This drying time, of course, varies depending on the coating amount, but the above range is appropriate in usual.

Examples of a method of applying the second coating solution the coating layer comprising the above first solution exhibits the falling-drying include (1) a method in which the second solution is further applied to the coating layer, (2) a method in which the second solution is applied by using a method such as spraying and (3) a method in which the support on which the coating layer is formed is dipped in the second solution.

As the method of applying the second solution in the above method (1), known coating methods may be utilized, these methods using a curtain flow coater, extrusion die coater, air doctor coater, blade coater, rod coater, knife coater, squeeze coater, reverse roll coater and bar coater respectively. However, it is preferable to utilize a method using, for example, an extrusion die coater, curtain flow coater or bar coater, that is not brought into direct contact with the first coating layer which has been already formed.

After the second solution is applied, the coating layer is dried and cured at 40 to 180° C. under heating for 5 to 30 minutes. Particularly, the coating layer is preferably heated at 40 to 150° C. for 1 to 20 minutes.

In the case where the above basic solution (second solution) is applied at the same time when the ink-receiving layer coating solution (first solution) is applied, the first and at the same time second solutions are applied (multilayer coating) such that the first solution is brought into contact with the support and then dried to cure the coating layer whereby the ink-receiving layer can be formed.

The aforementioned simultaneous coating (multilayer coating) can be attained by a coating method using an extrusion die coater or curtain flow coater. After the simultaneous coating is finished, the formed coating layer is dried. In this case, the drying is usually carried out by heating the coating layer at 40 to 150° C. for 0.5 to 10 minutes and preferably at 40 to 100° C. for 0.5 to 5 minutes.

When the above simultaneous coating (multilayer coating) is carried out by an extrusion coater, these two solutions injected at the same time are formed as a multilayer in the vicinity of the exit port of the extrusion die coater, specifically, before these solutions are transferred to the support and applied to the support in that state. The two layer coating solutions formed as a multilayer before they are applied tends to cause a crosslinking reaction at the interface between these two solutions already when transferred to the support and the two solutions to be injected are mixed to increase the viscosity with ease around the exit port of the extrusion die coater, affording such an opportunity that the coating operation is hindered. Therefore, when these two solutions are applied simultaneously as mentioned above, a barrier layer solution (intermediate layer solution) is interposed between the first and second solutions to apply these three layers simultaneously.

Any barrier layer solution may be selected as the aforementioned barrier layer solution without any particular limitation. Examples of the barrier layer solution may include an aqueous solution containing a trace amount of a water-soluble resin and water. The above water-soluble resin is used in consideration of coatability for the purpose of thickening. Examples of the water-soluble resin include polymers such as cellulose type resin (e.g., hydroxypropylmethyl cellulose, methyl cellulose and hydroxyethylmethyl cellulose), polyvinyl pyrrolidone and gelatin. The barrier layer coating solution may contain the above mordant.

After the ink-receiving layer is formed on the support, the ink-receiving layer can be improved in surface smoothness, glossiness, transparency and coating layer strength by using a super calendar, gloss calendar or the like to carry out calendaring treatment by allowing the support to pass between roll nips under heating and pressure. However, because there is the case where this calendaring treatment causes a reduction in porosity (namely, there is the case where the ink absorbance is deteriorated in some cases), it is necessary to carry out the calendaring treatment under the situation where a reduction in porosity is prevented.

In the case of carrying out calendaring treatment, the roll temperature is preferably 30 to 150° C. and more preferably 40 to 100° C.

Also, the linear pressure between rolls in the calendar treatment is preferably 50 to 400 kg/cm and more preferably 100 to 200 kg/cm.

It is necessary to decide the layer thickness of the ink-receiving layer in relation to the porosity in the layer because the ink-receiving layer must have absorbing capacity enough to absorb all liquid droplets in the case of using the ink-receiving layer for ink jet recording. For example, when the amount of ink is 8 nL/mm$^2$ and the porosity is 60%, the layer thickness is preferably about 15 μm or more.

Taking this point into account, the layer thickness of the ink-receiving layer is preferably 10 to 50 μm in the case of using this ink-receiving layer for ink jet recording.

Also, the pore diameter of the ink-receiving layer is preferably 0.005 to 0.030 μm and more preferably 0.01 to 0.025 μm in terms of median diameter when the ink-receiving layer is used for ink jet recording.

The above porosity and pore median diameter may be measured using a mercury porosimeter (trade name: BORESIZER 9320-PC2, manufactured by Shimadzu Corporation).

Also, the ink-receiving layer is more preferable when it is more transparent. As to the standard of the transparency, the haze value of the ink-receiving layer obtained when the ink-receiving layer is formed on a transparent support is preferably 30% or less and more preferably 20% or less.

The aforementioned haze value may be measured using a haze meter (trade name: HGM-2DP, manufactured by Suga Test Instrument Co., Ltd.).

Polymer microparticle dispersion may be added to the structural layers (for example, the ink-receiving layer or back layer) of the ink jet recording medium. The polymer microparticle dispersion is used with the intention of improving layer characteristics such as dimensional stability, curling prevention, prevention of sticking and prevention of cracks of the film. There are descriptions concerning the polymer microparticle dispersion in each publication of JP-A Nos. 62-245258, 62-1316648 and 62-110066. When a polymer microparticle dispersion having a low glass transition temperature (40° C. or less) is added to the aforementioned layer containing a mordant, cracks and curling of the layer can be prevented. Also, even if a polymer microparticle dispersion having a glass transition temperature is added to the back layer, the layer can be prevented from curling.

EXAMPLES

The present invention will be explained in more detail by way of examples, which are not intended to be limiting of the invention, in which all designations of "parts" and "%" are on mass basis and the designation of "degree of polymerization" indicate "weight average degree of polymerization", unless otherwise noted.

Example 1

Production of a Support 50 parts of maple wood craft pulp (LBKP) and 50 parts of acacia wood craft pulp (LBKP) were respectively beaten by a double disk refiner to obtain a pulp slurry having a Canadian freeness (Canada standard Freeness) of 330 ml.

Then, 1.3% of cationic starch (trade name: CAT0304L, manufactured by Nippon NSC Ltd.), 0.15% of anionic polyacrylamide (trade name: DA4104, manufactured by Seiko PMC (k.k.)), 0.29% of an alkyl ketene dimer (trade name: SIZE PINE K, manufactured by Arakawa Chemical Industries, Ltd.), 0.29% of epoxidized behenic acid amide and 0.32% of polyamidopolyamine epichlorohydrin (trade name: ARAFIX 100, manufactured by Arakawa Chemical Industries, Ltd.) per pulp were added to the resulting pulp slurry and then, 0.12% of an antifoaming agent was further added.

The pulp slurry prepared in the above manner was subjected to a Fourdrinier paper machine where it is dehydrated and dried to make raw paper having a basis weight of 200 g/m$^2$ and a thickness of 190 μm, thereby obtaining base paper.

Specifically, in the step of applying the felt surface of the web to the raw paper through a drier canvas to dry the raw paper, the tensile strength of the drier canvas was set to 1.6 kg/cm to dry. Then, a polyvinyl alcohol (trade name: KL-118, manufactured by Kuraray Co., Ltd.) was applied to both surfaces of the raw paper in an amount of 1.0 g/m$^2$ by a size press and dried to carry out machine calendaring treatment.

The wire surface (back surface) side of the obtained base paper was subjected to corona discharge treatment and then, coated with high-density polyethylene 4 μcm in thickness by using a melt extruder to form a polyethylene resin layer having a matt surface (hereinafter, this polyethylene resin layer side is called "backside"). The surface of the polyethylene resin layer on the backside was further subjected to corona discharge treatment and was coated with a dispersion prepared by dispersing aluminum oxide (trade name: ALUMINA SOL 100, manufactured by Nissan Chemical Industries, Ltd., antistatic agent) and silicon dioxide (SNOWTEX-O, manufactured by Nissan Chemical Industries, Ltd.) in a ratio of 1:2 such that the dry mass was 0.2 g/m$^2$.

Further, the felt surface side (front side) on which the polyethylene resin layer was not formed was subjected to corona discharge treatment, and then, low-density polyethylene having a MFR (melt flow rate) of 3.8 and containing 10% of anatase type titanium dioxide, a trace amount of ultramarine blue (manufactured by Tokyo Ink) and 0.08% (based on polyethylene) of a fluorescent whitening agent (trade name: WHITEFLOUR PSN CONC, manufactured by (k.k.) Nippon Kagaku Kogyosho) was extruded using a melt extruder on the felt surface side such that the thickness was 40 μm wherein the nip pressure between the elastic roll and the cooling roll was adjusted to 3.5 MPa, to thereby form a highly glossy polyethylene resin layer on the surface side of the base paper (hereinafter this glossy surface is referred to as "Front surface") and thus a support was made (hereinafter referred to as a support A).

Here, as the elastic material constituting the elastic roll, a material which was made of ethylene propylene rubber and had a hardness of 80 in terms of value expressed by JIS K-6301 and a body thickness of 25 mm was used. Also, the roughness of the surface of the elastic roll was 0.3 S in terms of value expressed by JIS B-0601.

—Preparation of an Ink-Receiving Layer Coating Solution—

(a) Vapor phase method silica microparticles, (b) ion exchange Water, (c) Sharol DC-902P and (d) ZA-30 in the following composition were mixed, pre-dispersed using a homomixer and further dispersed using a liquid-liquid collision type dispersing machine (trade name: ALTIMIZER, manufactured by Sugino Machine Limited) under 170 MPa by one pass. The resulting dispersion solution was heated to 45° C. and retained for 20 hours. Then, (e) a boric acid solution, (f) a polyvinyl alcohol solution, (g) a surfactant, (h) polyoxyethylene lauryl ether and (i) ethanol contained in the following composition were added to the dispersion solution at 30° C. to prepare an ink-receiving layer coating solution. The ratio by mass (PB ratio=(a)/(f)) of the silica microparticles to the water-soluble resin was 4.5 and the pH of the prepared ink-receiving layer coating solution was 3.9 showing acidic state.

<Composition of an Ink-Receiving Layer Coating Solution>

| | |
|---|---|
| (a) AEROSIL 300SF75 (manufactured by Nippon Aerosil Co., Ltd., vapor phase method silica microparticles, average primary particle diameter: 7 nm) | 10.0 parts |
| (b) Ion exchange water | 64.8 parts |
| (c) SHAROL DC-902P (aqueous 51.5% solution) (manufactured by (Dai-ichi Kogyo Seiyaku Co., Ltd.) | 0.87 parts |
| (d) ZA-30 (Dai-ichi Kigenso Kagakukogyo (k.k.) | 0.49 parts |
| (e) Aqueous 5% boric acid solution | 0.40 parts |
| (f) Polyvinyl alcohol (water-soluble resin) solution (Composition of the solution) | 32.0 parts |
| PVA-235 (manufactured by Kuraray Co., Ltd., saponification value: 88%, degree of polymerization: 3500) | 2.0 parts |
| Polyoxyethylene lauryl ether (trade name: EMULGEN 109P, manufactured by Kao Corporation) | 0.03 parts |
| Compound 1 shown below | 0.12 parts |
| Diethylene glycol monobutyl ether (trade name: BUTYCENOL 20P, manufactured by Kyowa Hakko Chemical (k.k.)) | 0.55 parts |
| Ion exchange water | 26.6 parts |
| (g) SUPERFLEX 650 (Dai-ichi Kigenso Kagakukogyo (k.k.) | 1.2 parts |
| (h) Polyoxyethylene lauryl ether (trade name: EMULGEN 109P (10% solution), manufactured by Kao Corporation, HLB value: 13.6) | 0.49 parts |
| (i) Ethanol | 2.5 parts |

Compound 1

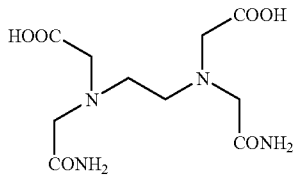

—Production of an Ink Jet Recording Sheet—

The front surface of the support obtained above was subjected to corona discharge treatment. An aqueous aluminum polychloride solution (aluminum polychloride (trade name: ALFINE 83, manufactured by Daimei Kagaku Kogyo (k.k.)) was used) which was diluted five times was in-line-applied at a rate of 10.8 ml/m$^2$ to the surface of the above ink-receiving layer coating solution which was made to flow at a rate of 180 ml/m$^2$ on the front surface of the support. Thereafter, the coating layer was dried using a hot air drier at 80° C. (wind velocity: 3 to 8 m/sec.) until the solid concentration was 20%. At this time, the coating layer showed a "constant-rate-drying" phenomenon. Just after that, the base paper was dipped in a solution A (pH=7.8) having the following composition for 30 seconds to apply the solution in an amount of 15 g/m$^2$ to the surface of the coating layer, followed by drying at 80° C. for 10 minutes. An ink jet recording sheet provided with an ink-receiving layer having a dry layer thickness of 33 μm was thus produced.

<Composition of a Solution A>

| | |
|---|---|
| (a) Boric acid | 0.65 parts |
| (b) ZIRCOSOL AC-7 (manufactured by Dai-ichi Kigenso Kagakukogyo (k.k.), ammonium zirconium carbonate) | 3.0 parts |
| (c) Ammonium carbonate (first class; manufactured by Kanto Kagaku Co., Ltd.) | 3.5 parts |
| (d) Ion exchange water | 63.3 parts |
| (e) Polyoxyethylene lauryl ether (trade name: EMULGEN 109P (aqueous 2% solution), manufactured by Kao Corporation, HLB value: 13.6) | 30 parts |

Example 2

A support B was produced and also an ink jet recording sheet according to the invention was produced in the same manner as in Example 1 except that the Canadian freeness after the pulp was beaten by a double disk refiner was changed to 280 ml from 330 ml in "—Production of a support A—" in Example 1.

Example 3

A support C was produced and also an ink jet recording sheet according to the invention was produced in the same manner as in Example 1 except that the thickness of the thermoplastic resin layer on the "front surface" was changed to 5 μcm from 40 μm in "—Production of a support A—" in Example 1.

Example 4

A support D was produced in the same manner as in Example 1 except that the nip pressure applied between the elastic roll and the cooling roll was changed to 2.0 MPa from 3.5 MPa and also an ink jet recording sheet according to the invention was produced in the same manner as in Example 1 except that the dispersion of the silica microparticles using the liquid-liquid collision type dispersing machine was carried out using a ultrasonic dispersing machine (trade name: UH-600H, manufactured by (k.k.) SMT) in a throughput of a flow rate of 3.0 kg/min.

Comparative Example 1

A comparative ink jet recording sheet was produced in the same manner as in Example 1 except that the liquid-liquid collision type dispersing machine was changed to a beads mill dispersing machine (trade name: KD-P, manufactured by (k.k.) Shinmaru Enterprise) in Example 1.

Comparative Example 2

A comparative ink jet recording sheet was produced in the same manner as in Example 4 except that the ultrasonic dispersing machine used for the dispersion of silica microparticles was changed to a beads mill dispersing machine (trade name: KD-P, manufactured by (k.k.) Shinmaru Enterprise) in Example 1.

Comparative Example 3

A support E was produced and also an ink jet recording sheet according to the invention was produced in the same manner as in Example 1 except that the Canadian freeness after the pulp was beaten by a double disk refiner was changed to 150 ml from 330 ml in "—Production of a support A—" in Example 1.

Comparative Example 4

A support F was produced in the same manner as in Example 1 except that 50 parts of maple wood craft pulp and 50 parts of acacia wood craft pulp used in "—Production of a support A—" in Example 1 were changed to 50 parts of acacia wood craft pulp and 50 parts of aspen wood craft pulp and a comparative ink jet recording sheet was produced in the same manner as in Example 1 except that the liquid-liquid collision type dispersing machine was changed to a beads mill dispersing machine (trade name: KD-P, manufactured by (k.k.) Shinmaru Enterprise).

(Evaluation)

The base papers obtained in the above examples and comparative examples and ink jet recording sheets constituted of these base papers were subjected to the following evaluations and tests. The results are shown in Table 1.

1. Formation (Index)

The base paper obtained in each of the examples and comparative examples was subjected to a 3D sheet analyzer (trade name: M/K950, manufactured by M/K Systems, Inc: (MKS Company)) wherein the diaphragm of the analyzer was set to a diameter of 1.5 mm and a microformation tester (MFT) was used, to measure the formation index. The formation index value shows that the larger the value is, the better the formation is.

2. Average Roughness of Center Surface (SRa Value)

(1) The base paper obtained in each of the examples and comparative examples was subjected to a three-dimensional surface structure analysis micrometer (trade name: ZYGO NEW VIEW 5000, manufactured by ZYGO (k.k.)) in the condition of a cutoff of 0.05 to 0.5 mm according to the following measurement condition and analysis condition to measure the center average roughness (SRa value).

<Measurement Condition and Analysis Condition>

| | |
|---|---|
| Lengths of measurement: | 10 mm in the direction of X<br>10 mm in the direction of Y |
| Objective lens: | Magnification of 2.5 |
| Band-pass filter: | 0.05 mm to 0.5 mm. |

(2) The base paper obtained in each of the examples and comparative examples was subjected to a surface shape measuring device (trade name: NANOMETRO 110F, manufactured by Kuroda Seiko (k.k.)) operated in the condition of a cutoff of 1 mm to 3 mm according to the following measurement condition and analysis condition to measure the center average roughness (SRa value).

<Measurement Condition and Analysis Condition>

| | |
|---|---|
| Scanning direction: | the direction of MD of a sample. |
| Lengths of measurement: | 50 mm in the direction of X<br>30 mm in the direction of Y |
| Measuring pitch: | 0.01 mm in the direction of X<br>1.0 mm in the direction of Y |
| Scanning speed: | 2 mm/sec. |
| Band-pass filter: | 1 mm to 3 mm. |

3. Image Clarity

Each ink jet recording sheet obtained in Examples and Comparative Examples was subjected to an ink jet printer (trade name: PM-G800, manufactured by Seiko Epson Corporation) to print a black (K) solid image in the following image recording condition.

<Image Recording Condition>

Paper setting: EPSON photographic paper

Image quality setting: Recommended setting <fine>

Paper size: L-size, with a margin

Image data: Non-compressed image of 8-bit RGB data

Data in an image: Uniform image data, R=0, G=0, B=0 (value: decimal digit value)

Image size, resolution: 5 cm×5 cm, 720 dpi

Moisture control prior to printing: 23° C., 50% RH, 6 hours or more

Drying condition before the measurement of image clarity value and regular reflection strength after printing: dried in the condition of 23° C.; 50% RH for 24 hours.

Print image data: RGB digital values (8-bit) are 0, 0, 0.

Printing setting-type of paper: EPSON photographic paper

Color: Color

Mode setting: Recommended setting, fine

Drying condition until the mapping value and the regular reflection strength are measured: Dried for one day in the condition of 23° C. and 50% RH.

Then, the image clarity value C (%) of the solid image part of each ink jet recording sheet was measured using an image clarity value measuring device (trade name: ICM-1, manufactured by Suga Test Instrument Co., Ltd.) under the following measuring and analysis condition according to the image clarity value test method prescribed in JIS H8686-2.

The measurement is made both in the main scanning direction and in sub-scanning direction of the printing. Then, the image clarity value C was measured every comb from the following equation (a) and then, the image clarity values C calculated for each comb are summed up to find the sum of the image clarity values. In the following equation, M represents a maximum wave height and m represents a minimum wave height.

$$\text{Image clarity value } C\ (\%)=\{(M-m)/(M+m)\}\times 100 \qquad \text{Equation (a)}$$

<Condition of Measurement and Analysis>

Method of measurement: Reflection

Angle of measurement: 60°

Optical comb: 2.0 mm, 1.0 mm, 0.5 mm, 0.25 mm, 0.125 mm

4. Regular Reflection Strength

Each ink jet recording sheet obtained in Examples and Comparative Examples was subjected to an ink jet printer (trade name: PM-G800, manufactured by Seiko Epson Corporation) to print a black (K) solid image to make a sample for measurement. The regular reflection strength of the obtained sample for measurement was measured in the following manner: a glossiness measuring meter (trade name: THREE-DIMENTIONAL AUTO-GONIOPHOTOMETER GP-200, manufactured by Murakami Color Research Laboratory) was used to find the peak of reflection strength by measuring the deformation at the following incident angle and light acceptance angle and the peak value was defined as the regular reflection strength.

<Condition of Measurement and Analysis>

Incident angle: 45°.

Light acceptance angle: 30° to 60°.

Resolving power: 0.1°

Diaphragm of incident light (aperture): 10 mm×10 mm

Diaphragm size on the light receiving side: 4.5 mmϕ

Calibrating method: Black standard plate (refractive index: 1.518)

5. Glossiness

Each ink jet recording sheet obtained in the examples and the comparative examples was filled in an ink jet printer (trade name: PM-G 800, manufactured by Seiko Epson to print a person, a still-life and a scene image, which were evaluated visually according to the following evaluation standard.

TABLE 1

| | Support | | | Ink jet recording sheet | | |
|---|---|---|---|---|---|---|
| | | Surface roughness SRa | | Sum of image clarity | Regular | |
| | Formation index | Cut-off 0.05 to 0.5 mm | Cut-off 1 to 3 mm | values (%) | reflection strength | Gloss feeling |
| Example 1 | 73 | 0.55 | 0.59 | 185 | 39 | G1 |
| Example 2 | 90 | 0.50 | 0.58 | 191 | 42 | G1 |
| Example 3 | 73 | 0.55 | 0.59 | 210 | 43 | G1 |
| Example 4 | 73 | 0.55 | 0.59 | 143 | 35 | G1 |
| Comparative Example 1 | 73 | 0.55 | 0.59 | 165 | 24 | G2 |
| Comparative Example 2 | 73 | 0.55 | 0.59 | 138 | 23 | G3 |
| Comparative Example 3 | 55 | 0.49 | 0.62 | 105 | 34 | G3 |
| Comparative Example 4 | 80 | 0.90 | 0.85 | 81 | 23 | G3 |

[Standard of evaluation]

G1: Superior in gloss feeling

G2: Almost good gloss feeling

G3: Poor gloss feeling

As shown in Table 1, the examples having such good values as to satisfy the range defined in the invention as the sum of image clarity values and regular reflection strength also has good gloss feeling visually. On the other hand, the comparative examples that fail to satisfy any of the above ranges of the sum of image clarity values and regular reflection strength are not always evaluated as good by an observer even if either one the sum of image clarity values and regular reflection strength is satisfied. Specifically, a gloss feel that an observer feels good can be improved by making a structure which satisfies the results of the image clarity value and regular reflection strength.

Example 5

Cast coat paper (trade name: BOTH SURFACE-CHROME COLOR, manufactured by Fuji Seishi (k.k.)) was used in place of the base paper in Example 1 and a 40-μm-thick resin layer was formed on the cast surface in the same manner as in Example 1. Except for the above, the same procedures as in Example 1 were conducted to manufacture an ink jet recording sheet according to the invention.

The measurements of the image clarity and regular reflection strength and the evaluation of gloss feeling were made in the same manner, to confirm that the ink jet recording sheet had the characteristics which complied with the invention.

Example 6

Using the support C of Example 3, an aqueous aluminum polychloride solution (aluminum polychloride (trade name: ALFINE 83, manufactured by Daimei Kagaku Kogyo (k.k.) was used) which was diluted five times was in-line-applied and the following second coating solution was applied simultaneously at a rate of 2 ml/m$^2$ to the surface of the support C to form a multilayer. Other procedures were conducted in the same manner as in Example 3.

<Second Coating Solution>

Titanium oxide microparticles in the following composition were mixed with ion exchange water and an aqueous polyvinyl alcohol solution and dispersed using an ultrasonic dispersing machine to obtain a second coating solution.

| | |
|---|---|
| (a) Titanium oxide microparticles (trade name: STR 100C, manufactured by Sakai Chemical Industries, Ltd., volume average primary particle diameter: 10 nm) | 10.0 parts |
| (b) Ion exchange water | 45.9 parts |
| (c) Aqueous polyvinyl alcohol (water-soluble resin) solution | 7.2 parts |
| (Composition of the aqueous polyvinyl alcohol solution) | |
| PVA-235 (manufactured by Kuraray Co., Ltd., saponification value: 88%, degree of polymerization: 3,500) | 0.5 parts |
| Polyoxyethylene lauryl ether | 0.01 parts |
| Compound 1 described above | 0.01 parts |
| Triethylene glycol monobutyl ether (trade name: BUTYCENOL 20P, manufactured by Kyowa Hakko Chemical (k.k.)) | 0.17 parts |
| Ion exchange water | 6.5 parts |

With regard to Example 6, the measurements of the image clarity values and regular reflection strength and the evaluation of gloss feel were made in the same manner to confirm that the ink jet recording sheet had the characteristics which complied with the invention.

INDUSTRIAL APPLICABILITY

The recording medium of the invention may be applied to ink jet recording capable of recording a high quality image having high glossiness and photographic feel.

The invention claimed is:

1. An ink jet recording medium comprising a substrate and at least one ink-receiving layer on the substrate, wherein said ink-receiving layer after recording has the characteristic that the sum of image clarity values is 130 or more (when measured by optical combs of 0.125 mm, 0.25 mm, 0.5 mm, 1.0 mm and 2.0 mm) and the regular reflection strength is 30 or more, wherein:

the center average roughness SRa of said substrate at least on the side on which said ink-receiving layer is formed is 0.70 μm or less when measured in the condition of a cutoff of 0.05 to 0.5 mm, and is 0.80 μm or less when measured in the condition of a cutoff of 1 to 3 mm, and the ink-receiving layer comprises a dispersion of inorganic microparticles, and the average primary particle diameter of the inorganic microparticles is 30 nm or less and the secondary particle diameter of the inorganic microparticles is 200 nm or less.

2. The ink jet recording medium of claim 1, wherein the sum of said image clarity values is 150 or more.

3. The ink jet recording medium of claim 1, wherein said regular reflection strength is 40 or more.

4. The ink jet recording medium of claim 1, wherein said substrate is base paper made of paper, the base paper having been subjected to calendar treatment during a paper-making stage or after paper-making.

5. The ink jet recording medium of claim 1, wherein said substrate is base paper made of paper, the base paper having a density of 0.7 to 1.2 g/m$^2$.

6. The ink jet recording medium of claim 1, wherein said base paper is coated with a polyolefin resin on at least one part of the side on which said ink-receiving layer is formed.

7. The ink jet recording medium of claim 6, wherein the layer thickness of said polyolefin resin is 20 to 60 μm.

8. The ink jet recording medium of claim 6, wherein said polyolefin resin is a polyethylene, a polypropylene, or a copolymer of ethylene and a vinyl alcohol.

9. The ink jet recording medium of claim 1, wherein said ink-receiving layer contains inorganic microparticles or organic microparticles.

10. The ink jet recording medium of claim 9, wherein the solid content of said inorganic microparticles or organic microparticles in said ink-receiving layer is 50% by mass or more.

11. The ink jet recording medium of claim 9, wherein said ink-receiving layer contains inorganic microparticles.

12. The ink jet recording medium of claim 9, wherein said inorganic microparticles are silica microparticles, colloidal silica, alumina microparticles or pseudo boehmite.

13. The ink jet recording medium of claim 1, wherein said ink-receiving layer is formed using a dispersion solution which contains inorganic microparticles and formed by an ultrasonic dispersing machine or a high pressure dispersing machine.

14. The ink jet recording medium of claim 1, wherein said ink-receiving layer has a layer thickness of 20 to 40 μm.

15. The ink jet recording medium of claim 1, wherein said ink-receiving layer contains a water-soluble resin.

16. The ink jet recording medium of claim 1, wherein said water-soluble resin is a resin having a hydroxy group as a hydrophilic structural unit.

17. The ink jet recording medium of claim 1, wherein said resin having a hydroxy group as a hydrophilic structural unit is a polyvinyl alcohol resin.

18. The ink jet recording medium of claim 1, wherein said ink-receiving layer contains a boron compound as a crosslinking agent for a hydrophilic resin.

19. The ink jet recording medium of claim 1, wherein said ink-receiving layer contains a mordant.

* * * * *